United States Patent [19]

Peters

[11] 3,976,796

[45] Aug. 24, 1976

[54] PACKAGE FOR DEMOLDING EMBOSSED BUTTER AND MARGARINE

[76] Inventor: Leo Peters, 750 Plymouth Road, SE., Grand Rapids, Mich. 49506

[22] Filed: June 30, 1975

[21] Appl. No.: 591,610

[52] U.S. Cl. ..... 426/115; 426/130; 426/389

[51] Int. Cl.[2] ..... A23C 15/00

[58] Field of Search ..... 426/106, 108, 115, 125, 426/130, 144, 389, 393, 413, 414, 512, 515

[56] References Cited

UNITED STATES PATENTS 3,410,699 11/1968 Peters ..... 426/130 X

FOREIGN PATENTS OR APPLICATIONS 515,382 8/1955 Canada ..... 426/414

*Primary Examiner*—Frank W. Lutter
*Assistant Examiner*—William Cuchlinski, Jr.

[57] ABSTRACT

A package of butter or margarine which is molded with multi-cubic dimensioned embossments permits the contents of the package to be demolded within the temperature range of 38° to 48°F without damaging the embossments. The package comprises a film-sheet within the thickness range of 0.005 to 0.20 inch which is thermoformed into a single-walled, unlined cup-like cavity, and butter or margarine is flow filled into the cavity. The side wall of the cavity has an inward taper of an angle no less than 5° in non-embossed portions of the wall and an angle of no less than 10° in embossed portions of the side wall. Peaks of the embossed surface have radii of no less than 1/32 inch and angles of no less than 20°.

6 Claims, 27 Drawing Figures

PACKAGE FOR DEMOLDING EMBOSSED BUTTER AND MARGARINE

BACKGROUND OF THE INVENTION

Field of the Invention

This invention is concerned with butter and margarine that has been flow filled into rigid, single walled, non-reversible, unlined, multi-cubic-dimensioned, thermoplastic formed, embossed surfaced, cup-like cavities that mold such food products into the shape and surface designs of such cavities, and then demold such products from such cavities with the embossed surfaced design of the products intact.

The manual art of molding embossed surfaces on butter is quite ancient. But as a commercial art, using the technique of flow filling into embossing walled packages, it is only about twenty years old. Its commercial practice with butter has been growing slowly during this time. Because of this slow growth with butter, no commercial demand has appeared yet in margarine.

The purpose of this art is not simply one of aesthetics alone; not simply to change a plain cube of fat into a fine-appearing food. It also has some nutritional value. Among nutritionists it is well accepted that a pleasing appearance enhances acceptance and consumption of any food. Because of this, some hospitals now serve my restaurant size embossed butter pats on their meal trays. Thus, any improvement in the costs and conveniences in using my embossed pats should also result in an improved market.

The table fats, butter and margarine, have been one of the last of the grocery-type consumables to lend themselves to the progress of appearance enhancement. And, despite considerable development effort, this area has failed to gain any extensive commercial acceptance. As the invention will show, the reasons for this have been diverse and, even for one skilled in this art, a cure for the reasons has been difficult to achieve.

Since butter especially has body characteristics that are fixed by legal definitions of its content, and therefore cannot be modified to meet special demands of the market, it appeared to me that such special demands had to be met, if at all, by a modification of the packages used to form embossed designs on table fats. But how? The approach and answers to this question are contained in the following description of the invention.

Definitions and General Objectives

A description of this new art, as encompassed in the term "multi-cubic-dimensioned embossments" has been adequately set forth in the past in my U.S. Pat. Nos. 3,310,699 and 3,798,335. But, for the purposes of this invention, the term requires additional and more specific parameters. This will be explained fully later herein. While this invention is applicable to both butter and firm-bodied margarine, this application will use butter as the exemplary product for purposes of description, with the understanding that it is applicable to both products.

By "firm-bodied" margarine is meant the margarine that has a body of comparable firmness to that of butter at home refrigerator temperatures within the 10° range of 38° to 48° F. It has a body that is firm enough to accept a mechanically applied wrapper which can be peeled off clean at home refrigerator temperatures. While there is some variation in the hardness of butter body due to seasonal, cow breed and dietary, and processing differences, the range in hardness is not sufficient to change the functional parameters of this invention. This is in sharp distinction to the "soft" margarine that cannot be wrapped, but must be packaged in a cup from which it can be dispensed only by scooping it out.

The term 'consumer" as used herein, applies to both restaurant and home consumers. And the "package" as used herein, applies to both the fractional ounce patties used in restaurants as well as the ¼-lb., and heavier, cubes used in the home. Thus, I am concerned herein with a package designed to meet the needs of both types of consumers.

The term "thermoformed plastic film-sheet" applies to thicknesses within the range of 0.005 to 0.020 inches. The reason I use the double word "film-sheet" is because there is no consensus among technical experts in the packaging and plastics industries as to what precisely is a "film" and a "sheet." Their nomenclature is confusing for much of the thickness span in which this invention is concerned. So, by using the word "film-sheet" a reading of this disclosure by one skilled in the art becomes more understandable in terms of the area of package property characteristics covered and required by my invention. They are characteristics that include properties that span, and are unique to, the particular plastic "films" and "sheets" that fulfill the functional requirements of this invention.

For the successful commercialization of this art, there are two basic functional problems: (1) molding (forming) the embossed surfaces within female die-like, cup-shaped, embossing-walled package cavities; and (2) demolding (dispensing) such embossed butter surfaces intact from their forming package cavities. Then, in the demolding problem, this invention must be able to resolve to the satisfaction of the consumer three basic requirements or objectives: (1) low cost; (2) simplicity and convenience in use; and (3) perfect embossments.

The consumer is the final judge of whether or not these problems have been solved, and the objectives met.

The consumer's judgment of (1) the cost, (2) the simplicity and convenience in use (demolding from the package in which the butter was purchased), and (3) the perfection of the embossment designs, against the plain non-embossed surfaced product, determnes whether or not embossed surface butter will be commercially successful. It is important, therefore, to consider these three objectives in relation to the two basic functional problems of molding and demolding as they have been practiced in the prior art.

Because (1) the consumer is the final judge of the commercial acceptability, and (2) it is at the point of demolding that she first experiences the functional mechanics of my invention, I consider the problem of demolding (dispensing from the package in which it is purchased) to be of primary importance and so will consider it first.

THE PROBLEMS

1. The Problem of Demolding Delicate Designs

The multi-cubic-dimensioned designs on the surfaces of table fats are defined as designs that are upraised from the plane of the basic shape and surface on which they rest, and that branch out in all multi-cubic-lines of direction that comprise the multiplicity of angles on such designed surfaces; angles that range from straight lines through circular planes. But in my prior art the multi-cubic-dimensions also define the "fineness" and "delicacy" of design of these multi-cubic-dimensioned embossments.

For example, my U.S. Pat. No. 3,410,699 contains an extensive definition of "multi-cubic-dimensioned" embossments and specifies finely delineated (as fine as 1/64 -inch wide) multi-cubic-dimensioned surfaces.

My U.S. Pat. No. 3,529,976 also specifies such finely delineated surfaces.

My U.S. Pat. No. 3,758,312 describes embossments that "have upraised lines and edges as fine as 1/64-inch wide at their uppermost and outermost extremities"; and again specifies finely delineated embossments as described in U.S. Pat. No. 3,410,699.

My U.S. Pat. No. 3,798,355 again refers to its embossments as being within the definition given in U.S. Pat. No. 3,410,699, and then repeatedly emphasizes the structural fineness of its embossments with such phrases as: finely delineated and have "tiny crevices, sharp edges and corners of the intricate and/or delicate designs"; and designs that are "intricate and involved," with "sharp peaks," etc. In this invention, the requirements for demolding included (1) a cohesive (hard bodied) butter; (2) a low freezing temperature (for additional hardness), and (3) a complete "wetting" onto the embossing walls. While these requirements produced a successful demolding functionability for the "delicate" and "sharp" designs in "hard" frozen butter, they did not demold reliably when butter was softer at the higher (above freezing) normal home refrigerator temperatures. At that time it appeared to me that the unreliable demolding results with softer, higher-temperatured butter were due entirely to the butter itself. As my present discovery reveals, this reason was only part of the answer.

All of these prior art inventions illustrate, and give evidence of, the desire for an ultimate degree of "perfection," a superb fineness and delicacy of design, in the designs of the embossments. Such ultimacy of design has indeed been commercially achieved in the past, but only with butter that has been hardened at low (freezing) temperatures, and/or with the dispensing methods and means not presently normal for the mass of consumers.

2. The Problem of Demolding per se

Plain (non-embossed) surfaced butter can be removed (dispensed) from its package wrapper, or smooth surfaced cup, without adhering to its packaging materials and with its surface intact, only if the dispensing (unwrapping or demolding) function is performed within, or below, the normal temperature of home refrigerators of 38° to 48°F. At these temperatures the butter is sufficiently hard or cohesive to release clean from such package walls. Above these temperatures butter becomes progressively softer, stickier, less cohesive to itself and more adhesive to its package walls, and, therefore, more difficult to remove cleanly from such package walls.

To be functionally acceptable to the consumer, butter must remove clean from its packaging within the 38° to 48°F. temperatures that are normal at the point of demolding. Any method of packaging butter that requires a deviation from this normal temperature range in the home would act as a depressant to the successful commercialization of such a method.

With embossed surfaced butter compared with plain surfaced butter, this demolding function has been a much more difficult problem because the multi-cubic-dimensions of the embossments have been considered a physical-mechanical barrier to a smooth, even, peelable, and/or slidable release of its surfaces from the embossing walls in which these surfaces are molded. To the prior art it appeared obvious that the dispensing of embossed butter was a severe problem. And the empirical use with finely delineated embossments confirmed that it was indeed a severe problem. The laborious and extensive efforts to solve the problem attest to the prior art[s estimate of its severity.

As evidence of this, it is helpful to examine two basic packaging and dispensing methods and means used by the prior art:

a. The methods that employ thin plastic films and/or secondary packaging

Thin (in the thickness range of 0.0005 to 0.003 inches), flexible, peelable, reversible, and/or soft thermoplastic films are used by the prior art in molding and demolding of embossed butter surfaces.

These methods may be exemplified, and the severity of the problem illustrated, by the quantity and quality of the unique, and minutely detailed, package structures disclosed in my U.S. Pat. Nos. 2,631,939; 2,752,251; 3,253,929; 3,410,699; and 3,529,976. These patents furnish extensive evidence of the commitment of the prior art to the necessity of such thin films for the effective demolding of embossed butter. The thin, delicate films used in these methods enabled them to be reversed, peeled, and/or stripped from the embossed surfaces without any damage to these surfaces at the normal home refrigerator temperatures.

Another method developed for the express purpose of giving the home consumer the maximum simplicity and ease in demolding is exemplified by my U.S. Pat. No. 3,758,312. With this method the embossed butter was demolded at the production plant and then packaged in a secondary package which protected the demolded surface against damage in commercial distribution.

While the packages of both these methods delivered perfect embossments to the consumer which were easy and simple to demold, they were also relatively expensive. Their high labor and material costs relative to plain surfaced butter severely limited their use and sales. Depending on the size of the butter pat, these methods priced butter to the consumer at 20 to 40 cents per pound more than the price of plain surfaced butter. Such price differences effectively closed most of the market to its sale.

It is an object of this invention, therefore, (1) to eliminate the high costs of the prior art while (2) providing simple demolding procedures and (3) perfect embossments for the consumer.

b. The methods employing a rigid monolithic package

By "monolithic" is meant a single-thickness-walled, self-supporting package. Such packages were made of embossed walled thermoformed plastics having a high level of rigidity. This meant the use of a plastic sheet in thickness gauges usually upwards of 0.020 inches thick. These monolithic packages therefore leaped from the 0.003 inch maximum thickness of the thin-film methods, all the way to and over the 0.020 inch thickness, even into self-supporting rigidities comparable to those found in metal cup packages (e.g., my U.S. Pat. No. 3,798,335 (col. 8, 1. 44)). They jumped completely over most of the range of thicknesses that are the concern of this invention. (My U.S. Pat. No. 3,758,312 used a 0.0075 inch thick sheet but this was simply for a protective cover and is not to be considered as a package in the true sense of the work, i.e., having embossing walls in entire direct contact with, and required to bear the weight of, filled contents.)

These methods represented a radical departure from their prior art, and because they eliminated double walls, linered walls, in-plant labor of demolding, and secondary packages, they enabled a much lower cost to the consumer. As a result, acceptance by the consumer increased measurably. These methods are exemplified by my U.S. Pat. No. 3,798,335.

However, to demold embossed butter from these "rigid" walled packages, the consumer was required to do so at temperatures under 32° F. Because the rigid walls would not peel, reverse, or flex sufficiently to release the embossed surfaces at normal home refrigerator temperatures, it was necessary to freeze and harden the butter to obtain release. This meant the consumer was required to store it in her freezer and demold the butter from its package while still at freezer temperatures. If she did not observe this precaution, then the embossed surface would not demold from the package walls. Because freezer space is limited in most homes, and because frozen butter is not at an immediately acceptable temperature for spreadability and serving on her table, this method lacked the normalcy and simplicity in use that the thin-film methods had provided. Thus, while the cost was much lower, and the demolded surfaces were design perfect, and consumer acceptance did increase, the inconveniences due to the freezer requirement again limited its commercialization on an extensive scale.

While the methods employing a rigid monolithic package are major developments in the art of molding and demolding embossed surfaces on butter, they did not cure the problem of demolding in the home to the entire satisfaction of the consumer. She still wanted the convenience of demolding at her customary refrigerator temperatures without paying any additional amount to obtain this convenience.

It is another objective of this invention, therefore, to eliminate (1) the inconveniences and (2) the need for freezer temperatures to demold the butter while at the same time (3) provide low cost packaging for embossed surfaced butter.

3. The Problem of Molding Embossed Surfaces on Butter

In one sense this problem is of secondary importance because it has been extensively considered, and several excellent optional solutions have been disclosed in my prior art inventions. However, in another sense, it can never be of secondary importance because whatever methods and means it uses, it is a pre-condition of, and it has a direct critical bearing on, the success of the demolding operation. It is impossible to disassociate the molding method and means from the demolding method and means if the latter is to function successfully for (a) low cost, (b) simplicity and convenience in home use, and (c) perfect finished demolded embossments.

The prior art of the patents listed above has extensively described the various methods and means that can be used successfully to (a) mold multi-cubic-dimensioned embossments on the surfaces of butter, and (b) produce the consumer requirements of (1) convenience for the housewife and (2) delivering perfect embossments to her table. But they did so at whatever cost was necessary to do so. The cost always turned out to be considerably higher than the packaging costs of the competing plain surfaced butter. As a result, sales of the embossed butter were limited.

Both the thin-film methods and the rigid-sheet methods of solving the problems in this field of art, each in their own particular ways, produced costs that were competitively restrictive in the market place. Neither of the methods had made the kind of demolding analyses that lies at the heart of this invention. Their methods and means incorporated plastic-material properties usually found either in thin films or in thick sheets. They were "either-or" methods. Adequate consideration had not been given to the butter demolding functional potentialities among the structural properties found in the areas where films and sheets overlap; i.e., in the upper range of film thickness (5 to 10 mil thick films) and in the lower range of sheet thickness (10 to 20 mil thick sheets).

As one skilled in this art, I can say that part of the reason the prior art had not also discovered a viable method and means to give the consumer the requirement of "low cost" was due to the confusing properties and nomenclature differentiating plastic films and sheets. It had appeared to me that there was a polarization of properties contained in such descriptive antonyms as flexible and inflexible, surface-conforming and surface non-conforming, self-supporting and non-self-supporting, peelable and non-peelable, releasable and non-releasable, wrappable and non-wrappable, bendable and rigid, soft and stiff, film-thin and sheet-thick; that they tended to be mutually exclusive and stood in direct opposition to each other. And, much of the descriptive terminology contained in this trade nomenclature was buttressed by my own empirical results.

So, as far as molding and demolding embossed butter is concerned, these in-opposition properties appeared self-defeating. It appeared obvious that insofar as a monolithic molding and demolding package was concerned, it was an impossibility to provide a single-walled, single primary, package that could incorporate both of the many in-opposition properties and all the consumer requirements. But it also gradually appeared obvious that unless and until this impossibility was accomplished, the commercially necessary consumer requirement of low cost was stymied and/or might never be achieved.

It was the solution of precisely this non-obvious impossibility that became the primary objective of this invention. It is the surprising accomplishment of this primary objective that has now supplied a breakthrough for low cost marketing of embossed surfaced butter.

DISCOVERIES OF THE INVENTION

In the development of this invention for maximum commercial acceptace, I kept in mind the need to achieve all three of the basic objectives of (1) simplicity in use, (2) perfect embossments, and (3) low cost. Any solution of the interrelated molding and demolding problems would contribute nothing valuable to the commercial advancement of the art if it did not achieve all three of the basic consumer objectives.

A consideration in depth of each of these objectives, along with a detailed background description of the two major discoveries that made the fulfillment of the objectives possible, is pertinent to an understanding of the contribution to the art made by this invention.

Consumer Objectives

1. Simplicity in use; or simple and easy demolding procedures.

To meet this objective it is obvious that embossed butter would have to provide methods and means that would fit into consumers' habitual conditions and procedures. For example:

a. Normal refrigeration

Butter is normally stored and held for immediate table use in home refrigerators having average temperatures about 10° above freezing, i.e., in the 38° to 48° range. At every meal during a day, butter moves in and out of these temperatures for normal family service. These temperatures normally permit the butter to be used and spread on foods served in most consumer families immediately after removal from refrigerator between meal storage. But, freezer temperatures do not permit such normal usage. Yet, even such recent prior art as my U.S. Pat. No. 3,798,335, issued in 1974, specifies the need for embossed butter to be of a "low temperature" to enable it to be demolded intact from its embossing cavity. And by low temperature the butter industry means freezing temperatures. In U.S. Pat. No. 3,798,335, I emphasized the freezing temperatures in claim 1, col. 14, lines 14 through 17 by the words "conveying it into and/or through a freezing tunnel, and thereafter removing said embossing surfaced butter from its die or package." These are the temperatures I must eliminate for an acceptable consumer use of my present invention.

So, it is an object of this invention to enable consumers to demold embossed surfaced butter from its package, and then serve and spread it soon after removal from normal home refrigerator (for freezer) temperatures, and do so with b. Customary and natural dispensing movements Unwrapping parchment paper or foil from plain cubes of butter involves simple, customary, and natural movements at the normal home refrigerator temperatures. The movements are easy, and the wrapper peels and releases from the butter intact, with the butter surfaces unmarred.

It is an object, therefore, of this invention to remove embossed surfaced butter from its package at temperatures and with movements of simplicity and ease, comparable to those of plain surfaced butter.

2. Perfect embossments -- A design discovery

Demolding embossed butter from its package under prior art methods involved packaging materials and/or temperatures which were outside the normal and customary conditions for butter handling and which, if not properly practiced, could destroy the perfection of the embossed surfaces. If the perfection of these surfaces was marred or destroyed, the consumer would not re-purchase the product. The consumer purchases embossed butter for its fine appearance on her dining table, and if this fine appearance is destroyed, there is no reason for purchasing it instead of the plain surfaced product. As a matter of fact, there is good reason for rejecting it because a plain surfaced cube of butter is more presentable on a dining table than an obviously multilated embossed butter surface.

During the interim from the discoveries of U.S. Pat. No. 3,798,335 to the time of this invention, I was searching for a way to use the advantage that had been brought to butter from U.S. Pat. No. 3,798,335 also for higher-temperatured, softer butter. As one skilled in the art, I had committed myself to multi-cubic-dimensioned embossments that (for me) represented the finest in aesthetic design values, and no deviation therefrom appeared desirable. It never entered my thinking to deviate from the finest which had already been accomplished.

It was at this point that I made my first discovery. In laboratory control testing for odor transmission of the plastic film used in my embossing packaging, I use empty reject packages (rejected because of incomplete design formation) from my butter production line. Then by happenstance some of these empty reject packages were also used to test demolding abilities at home refrigerator temperatures. To my surprise, this butter with its "incompletely formed" designs demolded at these higher temperatures. I say incompletely formed because the designs on the embossing walls of the cavity of the reject packages were not filled out to their full delicate fineness as they normally have been in the commercial application of my butter embossing art.

Then I immediately tried it with good, fully completed and formed, embossing designs on my forming packages, but then it did not work.

On repeated testing I became aware that all the poor demolding results came at the finely delineated delicate line, sharp edge areas of the embossments. Designs were broken, and product lost, by the soft temperatured butter clinging to such areas of the embossments in the molding package. It was this discovery of the critical demolding role of the embossments that first focused my attention on the structure and functions of the embossments per se and, in turn, eventually led to the complete invention disclosed herein.

It is the major object of this invention, therefore, to provide an embossing walled package structure having multi-cubic-dimensioned embossments that will mold, and then demold such butter with their embossed surface designs intact at normal home refrigerator temperatures.

3. Low Cost

The prior art delivered embossed surfaced butter on to the consumer's table with its embossed surfaces in perfect condition, and with methods and means that made its demolding simple and easy. But they did so at a cost so high that a widely accepted commercialization was effectively stymied. This high cost was produced by one and/or two factors:

a. The quantity labor required to demold the butter at the packaging plant from its primary (molding) package or die, and then package it in a secondary (protective-only) package for shipment to the home; and/or b. The quantity of materials involved in either and/or both the primary and secondary packaging of such butter.

It is a two-fold objective of this invention, therefore, to:

a. Eliminate the demolding and secondary packaging labor at the packaging plant and transfer the demolding function and labor to the consumer with a method and means that is comparable or superior in cost and simplicity to unwrapping plain butter, and that fits into her customary dispensing temperatures and b. Eliminate the secondary packaging materials now used by the prior art.

4. Overall Objective

It becomes the overall objective of this invention to provide a package for:

a. Molding embossed surfaced butter in the same package from which it will be demolding, and b. Accomplish the demolding in the consumer's home c. Under the same refrigerator temperatures and d. Comparably simple and easy movements to which she is now accustomed with plain surfaced butter, and do all this e. With embossments being demolded in perfect condition, and f. At a cost low enough to make the price closely competitive to the price of plain surfaced butter.

Problems in Achieving the Objectives with Film-sheets

Because of the number, the interrelationships, and the interdependencies of the problems in the art of butter embossments, commercial advancements have come slow and hard. These problems may be briefly described as follows:

1. The Problem of Conflicting Objectives

Being skilled in the art, I was sensitive not only to the problems and objectives as they directly concerned the all-important consumer, but also to the problems of meeting on a high speed production line the requirements needed to solve all the problems and meet all the objectives.

Again, being skilled in and sensitive to all the problems in this field was a problem in and of itself, because the apparent complexities of apparently unsolvable problems and conflicting and unattainable objectives frequently obscured even the probability of a solution. In this sense, and in retrospect, being skilled in the art acted as an impediment, rather than an aid, to progress toward a solution. For example:

a. On the one hand, I knew the need for a package molding structure from, and with, which the consumer herself to her own satisfaction could effectively perform the demolding, and thus eliminate the labor cost of demolding at the packaging plant.

b. On the other hand, I knew that if such a structure were to produce a low cost for molding at the plant, it had to be a monolithic single-walled package that could function as a self-supporting structure (like the cups for soft margarine) against the deformation of embossing walls under the weight of flow-filling butter and then the subsequent physical handling into shipping containers, into refrigerated storage, and through the channels of distribution all the way into a consumer's kitchen.

A common satisfactory solution to these two particular problems has eluded the prior art for years. In both theory and experimentation, they appeared mutually defeating. For example:

a. On the one hand, a package structure that was self-supporting for filling and handling was too rigid to perform the demolding function in the home; while b. On the other hand, if it was flexible (non-rigid) enough to perform demolding in the home, it was either deficient in its ability to be self-supporting during filling and handling or too complicated and expensive to be commercially successful.

There were other similar in-opposition film-sheet properties of an apparently commercially self-defeating character which have, until now, effectively blocked progress toward the solution disclosed in this invention. The solution was neither obvious nor came about suddenly, but rather is the result of plodding and attentive observation and experimentation in the fact of theory and evidence that apparently precluded an answer. If any obviousness was present, it pointed away from, rather than toward, the solution disclosed in this invention. The present invention, is, therefore, a surprising contribution toward the commercialization of the art of embossed butter surfaces because it has finally fulfilled all the objectives desired by consumers.

The most surprising aspect of the final solution is its utter simplicity and, in hindsight, what should have been its obviousness even in the face of evidence and mental attitudes that stood as barriers to this solution.

2. The Problem of Conflicting Film-sheet Properties

The prior art reasoned that the solution of the dual problems of (1) molding butter in and (2) demolding butter from embossing walled packages, while meeting the objectives of the consumer at the same time, required a packaging material and structure that must have properties and perform functions which, in broad areas, are in direct conflict with and opposition to each other. For example, it reasoned that for molding purposes, such a material must have the properties and provide a structure of stiffness and rigidity of an order to be self-supporting under the pressures and stresses encountered during filling and transportation; and for demolding purposes, it must have the properties and structure to provide flexibility and softness of an order to be peelable and/or reversible for an easy release of its embossed contents with embossments intact.

It is obvious from the failure of the prior art to solve to the complete satisfaction of the consumer the dual problems, and meet the three consumer objectives, that its reasoning did not lead to the right combination of material properties, package structure and methods and means for a successful large-scale commercialization of the art; that until this invention, such a combination had eluded discovery.

Because the embossment packaging of butter requires a detailed configuring of multi-cubic-dimensions, the best commercial type of material to accomplish this is thermoformable plastics. And, because of the manipulability of chemical formulations, a wide range of end properties can be tailored into specific thermoplastic films and sheets. A film can be made thin that is relatively stiff and rigid, while a sheet can be made thick that is relatively soft and flexible. A film of one thinness or thickness can be made either peelable and reversible, or can be made non-peelable and non-reversible. Thus, the field of thermoformed plastics offered the most promise for a solution of this invention's problems and objectives.

But, while the properties of stiffness and rigidity, softness and flexibility, peelability and reversibility, all may offer specific contributions to specific areas of a solution, it will be obvious from the antithetical nature of some of these properties that any contributions they might make toward a solution would require a closely balanced non-negating interrelationship if the solution is to be of practical value.

It is an object of this invention to provide such a closely balanced non-negating relationship.

3. The Problem of Designs per se

To achieve the objectives of this invention, I provide embossments with specific limitations on the structure of their designs. These limitations may represent a lowering of the aesthetic standards used in my previous disclosures but, on the other hand, they provide a very significant improvement in the art of demolding the embossed surfaces of butter. These limitations represent entirely new knowledge in this field of art; knowledge that will enable a sizable commercial extension to take place in an area, i.e., demolding at home refrigerator temperatures, that hitherto has hindered progress.

The critical and previously obstructive part of this art, so far as home refrigerator temperatures are concerned, is in the "fineness" of the designs previously used. Fineness of structural design has, within my concepts of this art, been specifically defined as 1/64-inch wide at is uppermost top extremities. Such fineness is produced by having small acute angles that produce sharp-pointed and narrow-ridged lines of design. It is precisely such small angles, sharp points, and narrow lines working together to produce a design structure that has obstructed perfect demolding with low cost packaging in the home market.

When the soft, frangible, relatively poor cohesive body of butter fills into embossing walls having such small-angled crevices, with their delicate, sharp, and narrow lines of design, it will not demold intact from such crevices under the conditions normally encountered in a consumer's home. Within such sharp and narrow crevices, the quantity of surface contacting the creviced walls is disproportionately large to the quantity not contacting these walls. Thus, the forces of adhesion exert an even greater influence on a body whose cohesiveness has already been weakened by the level of temperatures in home refrigerators.

It is thus a further objective of this invention to change and reverse this relationship so that the forces of cohesion will be greater than the forces of adhesion within the design areas of a butter body having multi-cubic-dimensioned embossed surfaces molded within an embossing walled package.

The sharpness of an outermost extremity by itself is not necessarily obstructive to intact demolding. Rather, it is the sharpness accompanied by a small acute angle of less than about 20° that produces broken designs on demolding. For example, a sharp 1/64-inch radiused edged point produced by a 90° angle might not be obstructive because there is a sufficient quantity of butter back of this point, and within this angle, to demold intact. But if the 1/64-inch point is produced by a 20°, or smaller, acute angle, then there is not a sufficient quantity of butter to demold intact. The 20°, or smaller, acute angle is not critical by itself. If it is accompanied by a relatively broad apex, one that has a 1/16-inch, or more, flat top, and/or a 1/32-inch, or more, radiused top (whose diameter provides the necessary 1/16-inch width for the apex), then it will function to demold intact. This is because the quantity of butter encompassed within such a design apex has a sufficient quantity of cohesiveness to keep itself intact against the lesser quantity of adhesiveness to walls forming such a relatively broad apex. Stated another way, the lack of fineness or delicacy or thinness of an apex so broadly structured renders it immune to breakage during a proper demolding operation at home refrigerator temperatures.

The basic and critical consideration for butter embossment structural designs is that the quantity of the forces of cohesion within such designs be greater than the quantity of the forces of adhesion, so that when demolded from their embossing walled package, the embossed designs will separate away from its walls free and clean with all areas of the design intact and complete. Thus my design parameters for the inside of my embossing cavity walls are limited to a peak sharpness which is no sharper than that produced by: (a) a 1/32-inch radius, (b) a width of no less than 1/16-inch and (c) an angle of no less than 20°.

The discovery of these functional limitations in structural-design parameters of multi-cubic-dimensioned embossments for the surfaces of butter cubes demolding at home refrigerator temperatures opens a whole new horizon for the practical commercial expansion of the butter embossment art.

4. The Problem of Thickness

Even though a thermoplastic film-sheet may be chemically structured to be stiff and rigid, or soft and flexible, or peelable and reversible, self-supporting or non-self-supporting in varying degrees and/or combinations, the physical property of thickness plays a unique and overriding common denominator role in the molding and demolding of embossed butter surfaces. Thickness per se can produce relative rigidity and/or flexibility, but in the art of molding and demolding embossed butter, it plays a special role.

a. For molding (1) Beauty of design

The relative thickness of a given flexible or inflexible thermoplastic film-sheet determines its relative ability to form shapes and/or precision-radiused corners. Therefore, its thickness has a direct bearing on the range, preciseness, and beauty of the designs that a given embossing film-sheet can emboss on butter surfaces. The thicker the film-sheet, the larger radiused and less precise and clear cut will be the corners and edges of its designs and vice versa.

Since the basic commercial purpose for embossing butter surfaces is to enable a consumer to improve the appearance of her dining table, it is critically important that the embossing walls be structurally capable of being thermoformed into clear cut beautiful designs, and then capable of demolding its butter with such designs intact.

(2.) Strength within the design

It cannot be so thin that even small sections of its designs collapse under the fluid filled and single or stacked weights of the butter; nor can it be so thick that any sections of its designs become crude and blurred.

(3.) Strength in the overall design

In addition to having strength to maintain design integrity in small sections of the embossments, there must be sufficient strength to maintain the overall shape of the embossed package walls under whatever single or stacked weights it is required to bear. Yet, it cannot be so strongly self-supporting that it cannot function for the demolding purposes of the invention.

b. For stacking

After filling, the molding package must be placed in a carton and/or stacked in layers into a shipping case with or without divider sheets between each layer. The thickness of a given film-sheet will have a direct bearing on the height, and also the accumulated weight, if any, which can be placed on top of the bottom package. Since the molding package is required to be a cup-like cavity, the closed or embossed bottom side encompasses the area on which the package rests. To prevent the embossments in this area from becoming disfigured from weight bearing, it is necessary to consider carefully the amount of stacked weight this area can bear without having the embossments disfigured. Stated another way: the package's film-sheet cannot be so thin that its designs will collapse or distort under whatever weight it is required to bear; nor can it be so thick that it will materially increase the weight which the bottom package in a stack must bear, and/or prevent perfect demolding under the objectives of this invention.

c. For demolding

For demolding purposes, the thickness of the embossing film-sheet is of even greater significance because it is the demolding function that is critical for maintenance of a perfect embossed butter surface. The intricacies in design of many multi-cubic-dimensioned butter surfaces requires some kind of releasing (demolding) movement; a flexing, folding, peeling, pushing, pulling and/or a reversing of its film-sheet if it is to be demolded intact at normal home refrigerator temperatures. But just what thickness, and what kind of movement and/or action was required remained the problem question.

It is an object of this invention, therefore, to provide an embossed monolithic film-sheet package that will be self-supporting, with all its embossments intact, under whatever weights it is required to bear; and in addition, will permit and/or provide a demolding movement that will function to release the embossed butter surface under the desired consumer requirements of this invention.

It is pertinent to the demolding problem to have a brief description of the physical condition that exists between fluid filled butter and the package walls into which it has been filled, and then the relation this condition has with (1) the thickness of the walls and (2) the movement and/or action required for demolding.

Once fluid butter has been changed from a fluid phase into a solid phase; i.e., from a mass that has a physically heterogeneous, unstable, undefinable and/or non-fixed dimensional structure, into one that has a homogeneous, stable, or self-defined and/or fixed dimensional structure, its cubic area and surfaces assume the shape and surface conformation of the package cavity into which it has been poured and/or cast.

Under my method (U.S. Pat. No. 3,798,335) of flow-filling into embossed walled package cavities, which is the method of molding used by this invention, the butter literally is required to wet itself onto the package walls for the purpose of excluding all air and producing perfect embossments between the butter and the embossing walled surfaces. As the butter is progressively cooled and solidified as its temperature is progressively lowered, a changing relationship takes place between itself and its embossing package walls, as follows:

(1) While still fluid, its cohesive body is weak, or, for practical purposes, non-existent. Its adhesion to its adjacent package walls is strong, and no air should be present between the butter and its package walls, setting the stage for a vacuum relationship.

(2) When the temperature of the butter drops below room temperature into the 50° to 60° F. range, the cohesion is stronger, but adhesion is still greater than cohesion, with the beginnings of a vacuum.

(3) When the temperature drops into the 38° to 48° F. range of home refrigerators, the strength of adhesion is given an assist from a vacuum relationship that has now developed between the package walls and butter. Without the presence of a vacuum, the strength of cohesion and adhesion are about in balance. To break the vacuum and any residual adhesion, it is necessary than an energizing movement or impetus be provided. And to enable such an impetus to be provided, the wall thickness and its resulting rigidity or flexibility must permit the required demolding movement or action.

(4) When the temperature drops down into the 10° to 20° F. range below the point of freezing, the cohesiveness of the butter becomes so great, and its adhesiveness so small, that it will easily break any residual vacuum and/or adhesion that may still be holding, provided the package walls are sufficiently rigid so as not to follow the contracting surfaces of the freezing butter.

It is the breaking of the vacuum that exists under the (3) condition, and provision for package wall thickness and movement under these conditions that is the critical objective of this invention because this is the temperature range within which butter is normally demolded in consumers' homes. This invention was specifically developed to avoid and eliminate demolding under the temperatures encountered under the (4) condition.

The temperatures encountered under (3) conditions, and their ensuing demolding problems exist whether the package walls are plain or embossed. But the prior art assumed that the problems of demolding embossed surfaces increase over demolding of plain surfaces in almost direct ratio to the increase in the quantity and complexity of the embossments, and, therefore, that the actions required for demolding embossed butter were also of an increasingly complex and extensive nature, and therefore, much more difficult to perform. It was this assumption that, because of the various reasons stated herein, had hardened into accepted fact for those skilled in the art. The practitioners of the art had assumed mentally, as something that should be clearly obvious, that the complex surfacing of embossed butter also, per se, meant much more complex and difficult demolding.

It became a necessary objective of this invention, therefore, to demonstrate that this accepted "fact" was false, if my invention hoped to achieve a level of demolding ease comparable to that of plain surfaced butter.

5. The Discovery of a Function

In the prior art one of two different basic functions performed the act of demolding embossed butter:

a. A peeling function performed by a very thin film, or b. A releasing function performed with a rigid relatively thick non-reversible sheet as the monolithic package walls, plus a freezing temperature that increased the cohesiveness of the butter so greatly that it completely negated the adhesiveness of the butter to the package walls, thus permitting the butter to release freely and intact from the walls.

But the prior art had not fulfilled all the consumer requirements which are the objectives of this invention. If it had, of course, this invention would not be necessary. However, the prior art appeared to me to have exhausted the functional options for fulfillment of the consumer requirements. As one skilled in the art, I had reached an impasse in developing a better demolding technology.

It was at such time that I made the second discovery of this invention: a new demolding function in the art of demolding embossed butter. It was a discovery that came about through pure happenstance and by indirection.

a. Discovery of a bellows

The discovery occurred while watching the playing of an accordion. In this particular instance, its playing movements held my fascinated attention. I had never before taken detailed note of the movements and structuring of this instrument. It is structured with a bellows made of rigid ribs between which are foldable, collapsible and expandable walls enclosing an air chamber.

As the bellows of an accordion are compressed and/or collapsed by pressure from both ends to expel air out of its chamber, its ribs and foldable walls move inward; and vice versa to impel air into its chamber. A different action, i.e., compressing one side while expanding the other side will also produce air impelling and expelling results. One side pushes inward compressing air on its side, while the other side pulls outward expanding air on its side. Depending on which side has the most vigorous action or whether the bellows movement starts from a collapsed or expanded phase, air is either impelled into or expelled out of the chamber. It is this side to side (not the end to end) action of an accordion that is illustrative of the functional aspect of my invention. It is an action which at one and the same time, with a single movement, can produce inside the bellows chamber both a push-in, contracting and/or collapsing movement, and a pull away, enlarging and/or expanding movement.

b. Its analogy for embossed butter

The analogy of a bellows action in expelling air from, and impelling air into, its chamber to a similar action of a film-sheet embossed surfaced cavity for expelling embossed butter from, and impelling air into, its cavity at first seemed remote. But it persisted. For example:

(1) If a film-sheet was formed into a butter embossing cavity that was either too thin or too thick, it could not provide and/or permit rapid, positive, and precise movements that would simultaneously (a) both push butter away from itself and pull itself away from the butter while (b) impelling air into voids opened between the embossed surfaced butter and its embossing package walls. However, if a film-sheet could be found that would provide a properly balanced and cooperative relationship among the three properties of thickness, rigidity, and flexibility, and the embossments on its walls had creases and/or fold-oriented ribs or designs to serve as starting and/or guiding points for movements to expand and/or collapse the film-sheet cavity's embossed areas, it might possibly be able to function to both (a) pull itself away from and push the embossed butter out of its embossing cavity and (b) impell air between the butter and its package walls. The mere probability of such a combination of actions and movements throughout the entire area of my embossed butter surfaces was sufficient to spur immediate research.

(2) If the bellows analogy was to provide a pertinent teaching, the demolding capability of my film-sheet would also need a structured design to simulate the bellows' ribs and folds. If my film-sheet was of the right thickness, then it would also have to be structurally designed so that within adjacent areas there could be folding rib-like collapsing and/or expanding movements both inwardly and outwardly; some sections pushing the butter away from itself, while other sections pulled themselves away from the butter and/or sucked air into the space created by the pull-away action.

With the bellows analogy as a reference, I experimented with various embossing designs and film-sheet thicknesses until I found a monolithic film-sheet of a minimum thickness and an embossing design with my design parameters that would function in a self-supporting capacity for weight bearing purposes for my smallest size pat and also demold the butter with its embossment intact, and at this point I noted two surprising fortuitous coincidences: (a) with the proper thickness of film-sheet and (b) the inside angles of my designs at 20° or more, a sufficient number of the multi-cubic-dimensioned embossments thermoformed into the walls of my embossing walled cavities did indeed function sufficiently like the push-pull, fold together-unfold apart, collapsing and expanding, actions of an accordion's bellows to demold and expel my embossed butter surfaces intact. I then tried this procedure with a film-sheet of minimum thickness also for my largest embossed butter pat. And it too, even more visibly, functioned with a push-pull action.

Just as the foldable portions of a bellows walls have inward-moving and outward-moving cornered foldable edges, so also my multi-cubic-dimensioned embossing package walls can have foldable-oriented designs with inward projecting and outward projecting cornered and/or curvatured sides and/or edges. And as the cornered edges of a bellows' folds will push in and pull out; i.e., collapse and expand the bellows under pressure from the player's hands, so too the cornered and curvatured edges of my embossing package's fold-oriented designs will produce both collapsing and expanding movements, will both push and pull away from the butter, under pressure from the hands that are demolding it from its package. The 20° acute angle minimum limit placed on the inside design angles for intact demolding purposes also is a preferred limitation for the purposes of promoting the collapsing-expanding movements. When inside design angles are made smaller than 20°, the dual expanding-collapsing movements become increasingly more difficult. The smaller the angles, the more difficult they are to unfold outwardly. It is the unfolding, i.e., the outward spreading movement of the inside acute angles of my fold-oriented embossing designs that enables both the collapsing and/or expanding actions to function for demolding the embossed butter surfaces without damage. Without the unfolding action (mostly expanding movements) it would not be possible to have the folding action (mostly collapsing movements). I have found that the minimum inside angle for this purpose is at the 20° mark. Therefore, to facilitate the demolding movements of my package, the 20° minimum inside design angle is also a parameter for this purpose.

c. Uniqueness of the discovery

It should be noted that my multi-cubic-dimensioned butter embossing walls with the fold (collapsible-expandable) oriented embossed surfaces, with film-sheet thicknesses that will permit folding and unfolding movements and also support the weight size of each butter pat, are, per se, a major contributor to the discovery of the push-pull principle for demolding embossed butter from its packages when combined with a film-sheet that will cooperate to produce such movements. My embossed butter created its own special demolding problems and now, fortuitously, contributed to the solution of its own problems.

By virtue of their very nature, i.e., the upward and downward, or outward and inward, levels of their radiused fold-oriented corners and/or fluted sides or edges, and the rib-like spacings between these edges at each level, the embossing walls provide the type of structure in miniature of which an accordion's ribbed folds, and bellows actions are made. They can produce an action which simultaneously both folds in and unfolds out, i.e., collapses and/or expands my film-sheet, which, in turn, both pushes and pulls away from, while sucking air between itself and, the embossed home-refrigerated butter, when pressure is exerted upon the butter filled film-sheet cavity for demolding the butter.

My U.S. Pat. No. 3,798,335 described and discussed the need to "wet" flow-filled butter onto the walls of an embossing cavity. This wetting produces a largely air-free contact between the molded butter and its cavity's embossing walls. Then, with the butter in a solid phase at refrigerator temperatures, the contact between it and its embossing walls is practically perfect and air-free. It is common knowledge in physics that where there is a perfect contact between two solid unyielding surfaces, a vacuum is present that will offer resistance to a separation of these surfaces. To release them, it is necessary to exert sufficient pressure to push and/or pull them apart while introducing air between them to "break" the vacuum. This is what the push-pull action of my embossments does to butter molded within the embossing walls. Additionally, once air is introduced at one point between my embossed butter surfaces and their embossing package walls, it travels quickly with a wave or rippling action into and across the entire surface of contact between my embossed butter and its embossing package walls. Not only does the push-pull action of my embossing walls vis-a-vis my embossed butter physically push and pull butter and walls apart, but it also "breaks" the vacuum and impels air into the spaces created by butter and wall separation.

As a matter of fact, this action is so functionally unique and efficient for the art of demolding embossed butter that, given the proper thickness and the proper balance between rigidity and flexibility in a specific film-sheet as it relates to both the size and weight of a butter pat and its embossments, the push-pull release and demolding action can even take place during rough handling impact pressures sometimes received during refrigerated stacking, storing, and transportation. Then, if held under continued refrigeration into the consumer's home, it may even demold by falling out freely simply by turning the package cavity upside down.

This indicates that in some instances, with some relatively simple designs, only a small degree of pressure and only a slight collapsing and/or expanding of the embossing walls is required to demold the embossed butter. And even with extensive and intricate designs it is never necessary to collapse and/or expand the embossing walls completely to eject and demold the butter from its embossing cavity. Thus, for a correct definition of the terms collapsing and expanding as used herein, it should be understood that they are only movements and actions, not required to reach a completed state of collapse or expansion as can occur in a true bellows structure. They are moving functions with an extent and sufficiency of movement that is relative only to the position of butter in the process of demolding, and not end states of collapse and expansion.

Under the structurings of this invention, it is now as easy to demold an embossed surface intact as it is a plain (non-embossed) surface, and it is actually simpler, easier, and cleaner than upwrapping plain sticks of butter.

Thus, it is the combination of:

(1) embossed surfaced butter in (2) a multi-cubic-dimensioned thermoformed embossing film-sheet cavity having (3) dimensionally-limited embossed designs (4) with foldable, twistable, collapsible and/or expandable spacings between fold-oriented corners and/or rounded sides or edges in the embossing cavity's walls;

(5) a monolithic wall of a specific thickness range that:

(6) is structured for both self-supporting during filling and stacking, and collapsing and/or expanding during demolding, that:

produced the discovery of the unique combined push and pull away function for perfect and easy demolding of embossed surfaced butter at home refrigerator (not freezing) temperatures.

Remove any one of these six elements necessary to produce the specific push-pull actions for embossed surfaced butter, and the combination with its resulting requirements for the consumer is lost. Furthermore, each of these six elements must be present for all of the several weights of butter pats used with this invention.

The three-fold uniqueness of this discovery lies in:

(1) The happenstance coincidence that the 20° minimum for the inside acute angles of my embossing designs is a necessary limitation for the purposes of both my:

(a) discovery of the design structures needed to prevent embossed butter design breakage; and (b) discovery of the functional movements needed to demold embossed butter at home refrigerator temperatures.

(2) The peculiar combination of factors required for the final successful two-fold, collapsing-expanding actions, and even more importantly in (3) the surprising fact that the answers for the two basic problems and the three consumer requirements for a commercially practical embossed butter package were supplied in large part (i.e., the second discovery) by the inherent nature and capability of monolithic multi-cubic-dimensioned embossing package walls themselves. Without the presence of such embossments there would have been no two-fold molding and demolding problems and no three-fold unfulfilled consumer requirements. But also without such embossments there would have been no solutions of the kind disclosed by the invention. And because the embossments themselves helped solve all of their own self-created problems, it is surprising that these solutions had not been made before.

It is an object of this invention, therefore, to provide a monolithic, specific thickness, embossed walled package with embossing designs for molding the surfaces of butter that will, under demolding pressure, produce a bellows-type collapsing and/or expanding movement at one or more points on the embossing walls which will in turn function to both push and pull away the package wall from the embossed butter and impel air in between the butter and the walls under the pressure exerted at the time of demolding.

6. Problems of Plastics per se

There is considerable confusion and no firm consensus within the packaging and plastics industries over the thicknesses that define the difference between a thermoplastic film and a thermoplastic sheet. Factors other than thickness such as: laminations; chemically tailored rigities and flexibilities; tensile, impact and tear strengths; end uses, such as over-wrapping and container fabrication; etc. enter into the considerations used to define a thermoplastic film or sheet. But thickness has been the greatest common denominator for a definition reference. And on this denominator there has been a partial agreement in the plastics industry that a thickness of 10 mils (0.010 inches) is the dividing line between a film and a sheet. Below 10 mils it is a film, above 10 mils it is a sheet.

Using the 10 mil thickness as the dividing line then, generally speaking, for the purposes of this invention, films are flexible, reversible, and non-self-supporting; sheets are stiff, rigid and self-supporting. Films are used for tightly over-wrapping and contacting goods or containers; sheets are used to fabricate containers which enclose wrapped or unwrapped goods.

The line of demarcation between film and sheet is of significance in this invention because I draw on properties of both film and sheet to solve my problems. I draw on the low flexibilities at the top end of the range of film thicknesses, and the low rigidities at the low end of sheet thicknesses. It is within the range of 5 mils (0.005 inches) under to 10 mils (0.010 inches) over the 10 mil thick line of demarcation between films and sheets, i.e., the 15 mil thickness range from 5 mils to 20 mils, that I have discovered properties in certain standard thermoformable plastics that will function for the purposes of this invention. Among standard commercial formulations of plastic film-sheets that can serve the functions of this invention are: unplasticized polyvinyl chloride, certain formulations of polypropylene and polyethylene, high-impact polystyrene, and certain formulations of the ABS plastics family based on the three monomers acrylonitrile, butadiene, and styrene.

7. The Problem of Specific Applications

Since embossed butter pats vary considerably in weight, size, shape, depths and extent of embossments, stacking heights for shipment, etc., it is necessary to treat each combination of characteristics, within the embossment design and film-sheet thickness parameters set by this invention, as a specific application for purposes of measuring the properties needed in a film-sheet to produce the objectives of this invention. The methods for determining the specific properties needed for specific applications may be summarized as follows:

a. The parameters of shape and surface structuring

In order for a collapsing push-pull action to function without destroying my embossed butter surfaces, there must be room available and/or a physical acccomodation to offset the space into which the collapsed area moves. If one area of my embossed cavity's walls move inward, another area simultaneously must move outward or the butter itself must move or its surfaces be damaged. If one area of my butter surface is occupied by collapsing walls, another area must be vacated by expanding walls, or the butter itself must move or its surfaces be damaged. With the total plane surface area of my cavity constant, i.e., non-stretchable, a reduction of the cubic area of the cavity at one point must be compensated by an increase at another point, or the butter itself must move or its surfaces be damaged. Obviously when the cavity's walls move into a folded collapsed condition, expanded space relief must be found for the fixed surface area of the cavity's walls at another point or else the fixed cubic and embossed surface areas of the butter would be damaged.

The parameters of my shape and surface design structures have as their objective, therefore, a limitation on any shaping and surface designing that would impede the ease of demolding and/or destroy the integrity of my designs. Stated positively, the limitations on my shape and design structures are calculated to faciliate ease of demolding and retain the integrity of my embossed designs.

(1) The shape

It is understood that my package is concerned solely with a monolithic cup-like cavity open on one side (the mouth and/or neck); and closed by embossing walls on all the other sides. The open side is for filling and emptying the cavity, i.e., for fluid butter entry into (molding), and for firm-bodied embossed surfaced exit (demolding) from, the molding cavity. The open side is the top of the cavity and the bottom (or base) or the embossed butter. The closed side directly opposite the open side is the bottom of the cavity which is preferably structured to have an embossed, but nevertheless level, plane area on which to rest and, along with the other closed sides, provides a self-supporting structure and posture during filling, shipping, and storage; and it is the top of the embossed butter when the butter has been demolded. Each of these sides has a special significance in demolding my embossed butter, as follows:

(a) The bottom side of whatever cavity shape used is the most critical and vulnerable for embossed surfaced butter because:

(i) It is the side on which the embossments rest during filling, transportation, and home storage. Its embossment structuring, therefore, must be able to withstand the weights and jars received during such handling without having its designs mutilated.

(ii) It is the side also that during demolding receives the most naturally greatest pressure from the hands of the demolding person as the cavity is turned upside down to demold the butter. Its structuring, therefore, must be able to collapse and/or expand under such pressures as to demold the butter without destroying the embossed butter surfaces.

(iii) It is the side which produces the top of the demolded butter. Thus, it is the area which receives the most prominent and critical inspection from consumer's eyes. Its structuring must be able to demold this area with the designs having critically acceptable integrity.

(b) The open side perimeter may be of any configuration from round to polyangular. But regardless of its shape, the open side has a particular and critical significance in the demolding of embossed butter because it is the fixed gateway through which shape and surfaces of the butter must exit. To retain at least the shape integrity of the base, and thus the original symmetry of the molded butter, the perimeter of the open side cannot restrict the free passage of the butter from its cavity. It cannot function like a attempt to push a square peg through a round hole. To do so, one or the other must change its shape and be damaged.

In the case of an embossed and molded butter cube and its embossing package, neither the shape of the package's open side perimeter nor the shape of the perimeter of the base of the butter can be changed. They are both of the same shape and total perimeter lengths at time of butter molding. The butter cannot change its perimeter shape or the perimeter dimensions of its base on penalty of disfigurement. The perimeter of the open side of the package could change its shape but only at the expense of disfiguring the butter. So, for practical demolding reasons for this invention it cannot change its shape.

But there is an equally important obstacle to a change in shape of the open side of the package, namely, the fact that it is thermoformed into an overall perimetric length that cannot, for all practical purposes, be expanded or contracted (collapsed). If one side was pulled outwardly, another side would have to move inwardly, and thus, the molded butter would have to exit through an opening not conforming to the shape of its base's perimeter.

Thus, in thermoforming both the general shape and the specific surface embossments of my package cavities, the parameters of design must allow for, and promote the need for, demolding through a package exit of a fixed overall perimetric length. Any collapsing and expanding, push and pull, demolding movements of the embossing package walls, therefore, must take place on and within the closed sides of the cavity away from the perimeter edge of the open side.

It is an objective of this invention, therefore, to limit the collapsing and expanding demolding movements to the surfaces of the closed sides of the embossing cavity, specifically excluding from such movements the perimeter edges of the open side of the cavity.

(c) The closed sides (excluding the bottom closed side) must taper inwardly from the edge and plane of the open side at an angle of no less than 5° if they are not embossed, and at an angle of not less than 10° if they are embossed. They may also be of any configuration from round to polyangular, but within the following embossing design limitations in combination which serve to distinguish my package from prior art butter and margarine packages and all of which, in combination, are objects of this invention.

(2) The embossing surface designs

To be cooperative toward the objectives of this invention, the embossing designs on my cavity's walls must preferably have, in combination, the following limitations:

(a) Be embossed from thermoformable film-sheet cavity walls that are within the thickness range of 0.005 to 0.20 inches;

(b) Have no longitudinal or diagonal directioned lines of design lying within a plane on any of the closed (non-bottom) sides whose inward angle of taper from the edge and plane of the open side is less than 10°; only design lines running vertically from the top and bottom of my cavity on such sides may be less than 10°;

(c) Have no undercuts, i.e., no angles which intercept or undercut the descending line and/or plane of taper of the cavity's walls from the edge and plane of the open side. This is in sharp distinction to such undercut walls as disclosed in my U.S. Pat. No. 2,713,544;

(d) Have at least 10% of the combined area of the closed sides of the cavity covered with embossments;

(e) Have within individual designs on any of the closed sides at least two collapsible and/or expandable type embossed designs within the same side or quadrant in which such an individual design is located;

(f) Be collapsible and/or expandable oriented. Collapsible and expandable in this invention does not mean they must collapse or expand to the extent of the rib-folds of an accordion's bellows. But they must be of a design which, under outside pressures, will commence a collapsing and/or expanding, an in-folding and/or out-foldihg action somewhat similar to the in-folding and out-folding, collapsing and expanding action of a bellows. The extent to which these actions must take place is determined by the extent required to demold a particular design's embossed butter. The basic requirement is that the designs on the package's walls are thermoformed into an orientation that will permit and/or promote such collapsing and expanding movements which in turn provide the push and pull away function for releasing embossed butter from its embossing walls which in turn sucks air into the cavity between the embossed butter and the cavity's inside surfaces.

As one section, area, and/or part of a design is pushed inward against the embossed butter surfaces, another section, area, and/or part of approximately equal and/or adjacent area must pull outward away from the surfaces. The push-in movement must find space relief for the fixed frangible butter surfaces and body with a pull-away movement of corresponding quality and quantity. It should be characteristic of such collapsing and/or expanding action to produce a rippling and/or wave effect in which the demolding inward-collapsing pressure at one point seeks relief from this pressure by expanding outwardly at another point. As the peak line of one embossment (first wave) recedes or pushes inward, the valley line of the next embossment (second wave) rise or pulls outward and/or space relief is provided by the base of the pat moving out of its cavity.

It is an objective of this invention to provide packages with embossing walled designs with such collapsing push-in, and expanding pull-away, rippling-wave capabilities.

b. The factor of weight bearing

The embossment packaging of butter covers a range of weights and surface designs that require specific film-sheet properties for specific weights and designs of particular cubes of butter. Weight of butter contents per embossed cube of butter range from frictional ounces as low as 0.1185 ounces (135 pats per pound) to 16.0 ounces for the pound size. Embossment designs can range from tiny, tighyly spaced, intricate designs covering the entire closed side surfaces of a 0.1185 oz. size restaurant patty to large widely spaces simple designs covering only 10% of the closed side surfaces of a pound home size cube of butter. The weight-bearing ability of the embossed film-sheet package cavity used for molding each of these diverse weights and designs must take into consideration not only the weight of its own contents but also the weights of the layers of package cavities and layer-divider sheets stacked on top of it in its shipping case.

c. The criteria for measurement

There are numerous instruments and gauges used to determine and rate the various properties of film-sheets. However, I have found that the simplest and most reliable method and means for determining the specific film-sheet to be be used for a specific weight and surface design for my embossed butter is the criterion furnished by each butter-filled package itself because it is directly and immediately market oriented and in and of itself must be its own final reference and judge. To accomplish this, I classify the various weights, embossment designs, stacked weights, etc. that the market requires. These requirements are then converted into packages which in turn are filled and tested with various thicknesses of embossed film-sheet candidates at various stacked heights. The testing references of criteria (1) the weight-supporting strength as indicated by the maximum weight a particular stacking arrangement produces, measured by the vertical compression distance this particular arrangement will produce on a particular embossed design. In other words, now much weight a particular pat and its design can bear during filling and shipment without mutilating the design; and (2) the push-pull demolding action on the cold butter itself of a selected film-sheet candidate.

The following chart may be used for a preliminary determination of the thickness of film-sheet best suited to support the maximum weight of a particular stacking arrangement and still function for the consumer requirements of this invention.

| Number pats Per Lb. | Weight per pat (ounces) | Approximate vertical compression distance stack can travel before mutilating the embossing wall designs (inches) | Thickness of film-sheets (inches) |
|---|---|---|---|
| 135 | .1185 | | |
| 120 | .1333 | 1/64 = .1875 | .0050 – .0060 |
| 100 | .1600 | | |
| 90 | .1777 | | |
| 80 | .2000 | 1/32 = .3750 | .0060 – .0070 |
| 70 | .2286 | | |
| 60 | .2666 | | |
| 50 | .3200 | 3/64 = .5625 | .0070 – .0100 |
| 40 | .4000 | | |
| 8 | 1/8 lb. | | |
| 4 | 1/4 lb. | | |
| 2 | 1/2 lb. | 1/16 = .7500 | .0100 – .0200 |
| 1 | 1 lb. | | |

The "vertical compression distance" column is a fairly accurate measuring guide for the weight that may be stacked on top of a given embossed butter surface because it visibly measures the point beyond which mutilation takes place. Two of the five factors that influence the measurements are quite stable, i.e., (1) the consistency and weight-resistance quality of the butter and (2) the fairly constant ratio in which the height of a pat changes in relation to the size and weight of the pat. The other factors: (1) the intricacies and size of the designs, with their effects on the resistance ability of the cavity; (2) the relative stiffness-flexibility of the film-sheet per se; and (3) the thickness of the film-sheet, will produce variations in the measurement guide shown above.

In the choice of a film-sheet thickness best suited for the weight and embossment of a particular butter pat, it must be understood that there can be considerable overlapping in choices of film-sheet thickness within the permissible thickness range of this invention. Because film-sheet properties can be so variable within a single chemical family of thermoformable resins, it is possible, for example, to use an .008 inch thick commercially-marketed film-sheet of a certain resin, which normally would be used only for my largest and heaviest restaurant pat, change its chemical formulation, and use it efficiently for my smallest and lightest weight pat. And, vice versa, use a .005 inch thick film-sheet, which normally would be used for my smallest and lightest weight restaurant pat, for the largest and heaviest pat.

The formulae for commercial production of film-sheets are normally fixed for the largest-use requirements of the market. Thus, they can be sold under a brand name at the lowest cost and on a basis whereby the end user is guaranteed fixed end-use properties. The easiest and lowest cost way to vary these properties solely for the physical changes encompassed in the properties of stiffness versus flexibility, etc. is to change the thickness, not the chemical formulae. Thus, by using commercially available film-sheets having general properties applicable to my chemical and functional requirements and then using the thicknesses of such film-sheets that fall within the range of thicknesses best suited for the preferred embodiments of my invention, as indicated by my chart, the chart then furnishes a useful and workably accurate reference for at least the preliminary choice of low cost film-sheets. Thus, thickness again is the best common denominator for selection of the best film-sheet for specific embodiments of my invention.

PRACTICE OF THE INVENTION

In practicing my invention I provide a package made from a thermoformed plastic shell cavity whose inside embossed surface serves as the female member of a die-casting process for which flow-filled butter is the male member on whose surfaces the female's embossed surfaces will be defined, impressed, and cast. After flowing butter into such a cavity under the methods and means disclosed in my U.S. Pat. No. 3,798,335 at a temperature and speed that enables it to fill all the designs on the walls of the cavity's embossing surfaces, the butter-filled cavity is covered with a lid and/or enclosed in a carton, and refrigeration hardened for shipment to retail stores. After purchase by the consumer it is held in her refrigerator within a temperature range of 38° to 48° F. until ready for consumption.

Upon removal from these refrigerator temperatures, the embossed surface butter will demold and release from its cavity with its surface designs intact by turning its cavity shell upside down (i.e., open side down) and energizing the demolding movements by pressing on the top outside of the shell.

DESCRIPTION OF THE DRAWINGS

The practice of my invention may be better understood by referring to the following illustrative drawings of specific examples.

DETAILED DESCRIPTION

FIGS. 1–4 illustrate a 1/4 lb. butter pat 15 which has been demolded from a plastic molding shell 16 (FIG. 1) made in accordance with the prior art. It will be noted that the upper surface 17 of the butter pat is provided with finely delineated multi-cubic-dimensioned embossments which include sharp peaks A, B, C, D, E, F, etc., having widths of at least 1/64 inch across their top points, these peaks being of the kind that can be obstructive to an intact demolding of butter at home refrigerator temperatures. The obstructive character of the peaks is illustrated in more detail at peaks A and F in FIGS. 3 and 4, which have inside angles of 20°.

Figure 1:
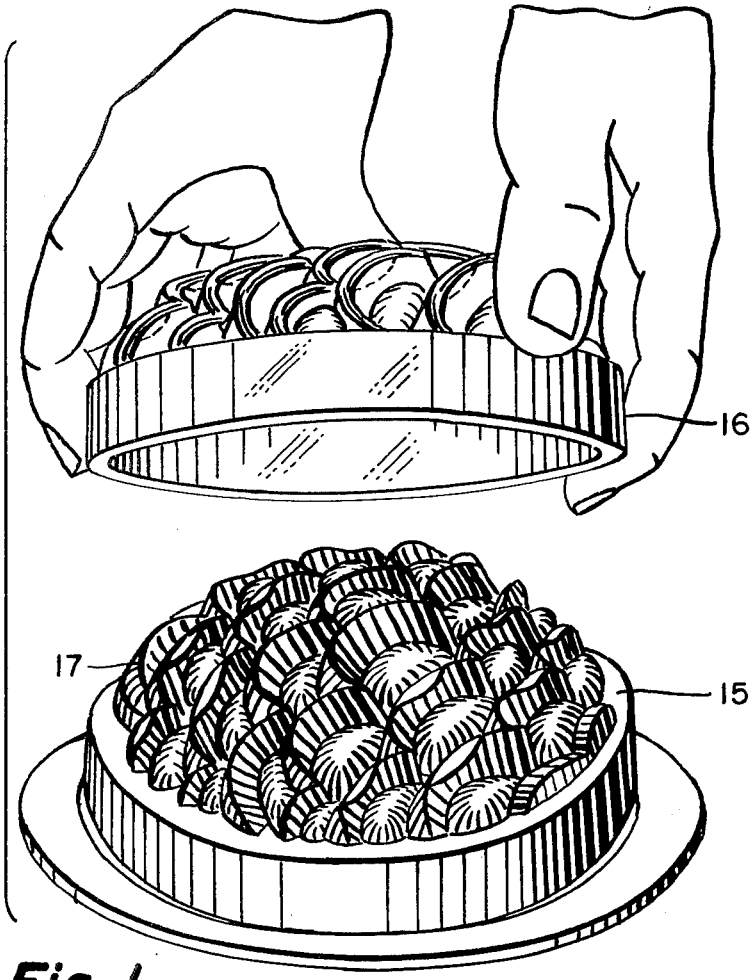
FIG. 1 is a perspective view of an embossed 1/4-lb. butter pat resting on a dish onto which it has been dropped by demolding it from its embossing walled plastic molding shell, the shell having its embossments formed with the delicate design specifications of the prior art.
Figure 2:
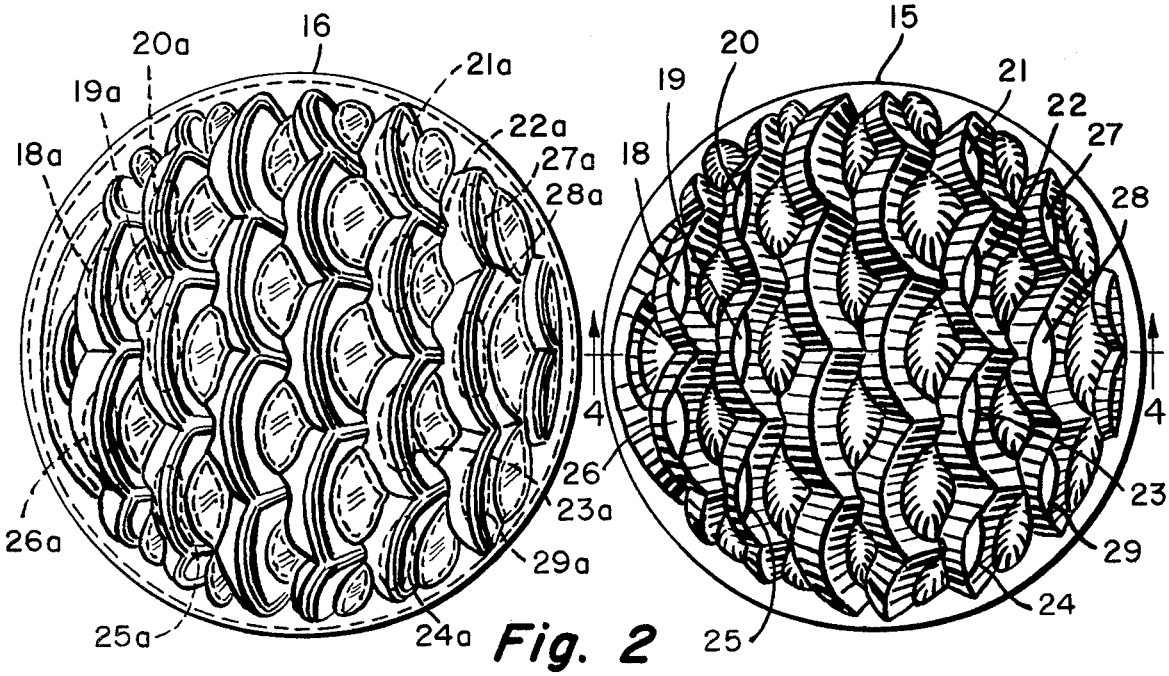
FIG. 2 is a top plan view of FIG. 1 showing the pat and the prior art shell lying alongside each other.

FIG. 2 shows 12 delicate, sharp peak areas of the embossments which have broken during the demolding operation. The twelve broken areas on the butter pat 15 are indicated by the reference numerals 18 through 29, and the corresponding twelve broken areas of butter which adhere to the inside of the molding shell 16 are indicated by the reference numerals 18*a* through 29*a*.

Figure 3:
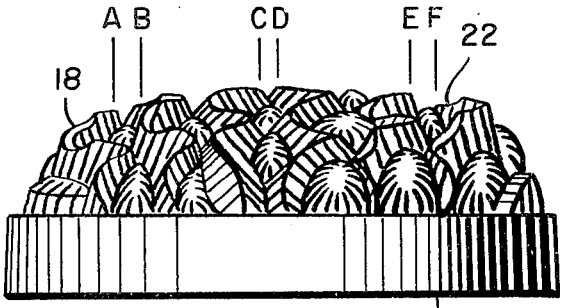
FIG. 3 is a side elevation view of the pat of FIG. 2.

FIG. 3 illustrates some of the broken areas of the pat 15 of FIG. 2 in a side elevation view.

Figure 4:
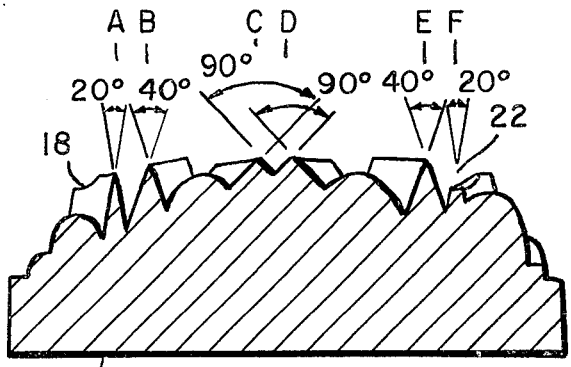
FIG. 4 is a sectional view of the pat of FIG. 2, taken along the line 4—4.

FIG. 4 shows in cross section both broken and unbroken areas of the pat and the critical role played by the specific angle of the design. It will be noted that where the angle of the design is 20° and its apex is sharp, pointed, and not visibly radisued, as at peaks A and F, then broken areas 18 and 22 result. However, even though the peaks are sharp, as at peaks B, C, C, and E, if the angle of the design structure is more than 20°, e.g., 40° at peaks B and E and 90° at peaks C and D, the embossed design remains intact after demolding.

Figure 5:
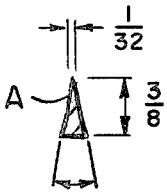
FIG. 5 is a sectional view of one of the embossments shown in FIG. 4.

FIG. 5 is a detailed cross section of design peak A of FIGS. 3 and 4, having a maximum depth dimension (⅜-inch) of a size found only in my home size pats. This particular peak has a 1/32-inch diameter (1/64-inch radiused) sharp apex and, along with it, a narrow acute angle of 20°. This is the kind of fine delicate design structure that breaks apart on demolding, i.e., where a sharp apex is combined with a narrow inside acute angle of 20° or less.

Figure 6:
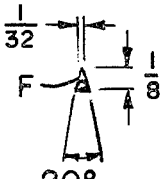
FIG. 6 is a sectional view of another embossment shown in FIG. 4.

FIG. 6 is a detailed cross section of design peak F of FIGS. 3 and 4, showing design dimensions more usual in my restaurant size pats; i.e., having a maximum depth dimension of ⅛-inch. This particular peak has a 1/32-inch diameter (1/64 -inch radiused), delicately sharp apex and, along with it, a narrow acute angle of 20°. This, too, is the kind of fine delicate design structure that breaks apart on demolding, again, where a sharp apex is accompanied by a narrow inside acute angle of 20° or less.

It is within such design peaks as illustrated in FIGS. 5 and 6, whose acute inside angles are 20° or less and whose apexes are 1/32 inch, or less, wide at the points of their peaks that butter embossments will not remain intact and unbroken during normal demolding temperatures and procedures. The embossment crevices within such molding cavities do not provide a sufficient cohesive quantity of butter to keep the design intact. Stated another way: within such embossments the quantity of butter exposed for adhesion to the molding surfaces is greater than the quantity of butter required to maintain sufficient intact cohesion to prevent the design structure from breaking apart on demolding. It is the small inside angle of 20° or less, and the sharpness of a peak having a radiused point with a diameter of 1/32 inch or less, in combination within an embossing design, that produces broken embossed butter surfaces upon demolding under the temperature conditions of this invention. Thus, the delicacy of the embossed designs in this invention is limited to designs having, in combination, inside angles of more than 20° and radiused peaks of diameters of more than 1/32 inch.

Figure 7:
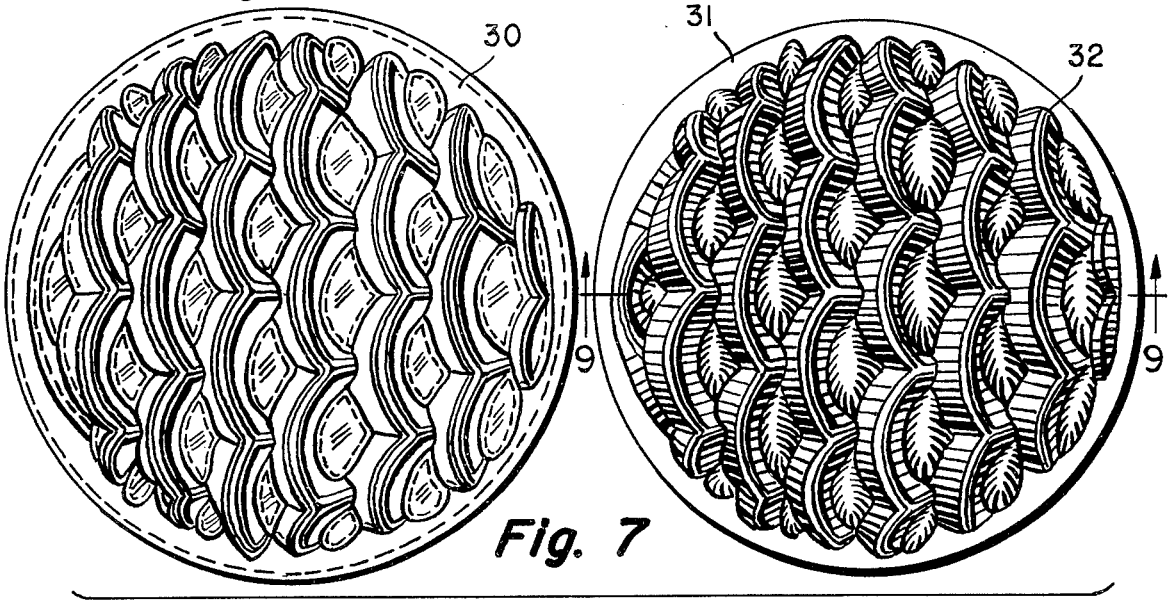
FIG. 7 is a top plan view of a 1/4 lb. pat and a plastic molding shell from which it was demolded, both produced according to the present invention.

FIG. 7 illustrates a molding shell 30 and a ¼-lb. butter pat or cube 31 demolded therefrom which are produced in accordance with the invention. All of the peak areas of the embossed upper surface 32 of the pat are intact. There is no evidence of design breakage or mutilation on either the shell or the pat.

Figure 8:
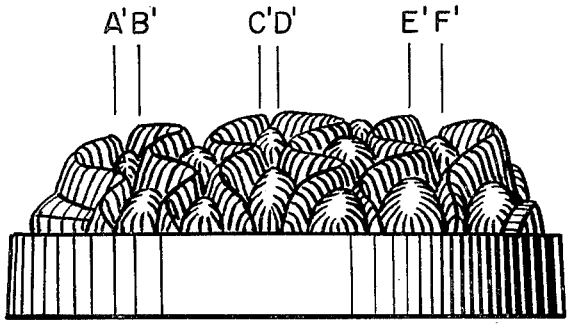
FIG. 8 is a side elevation view of the pat of FIG. 7.
Figure 9:
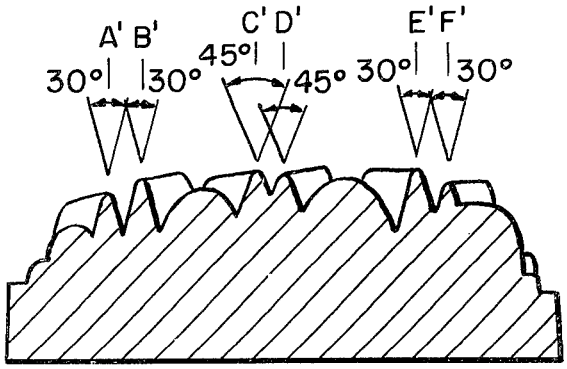
FIG. 9 is a sectional view of the pat of FIG. 7 taken along the line 9—9.

FIGS. 8 and 9, with peaks A′, B′, C′, D′, E′, and F′ corresponding to the peaks A–F of FIGS. 3 and 4, show the intactness of the demolded design structure more clearly. FIG. 9 especially shows in cross section the modified design areas, structurally modified according to the specifications within the limitations called for by this invention. In addition to all angles being over 20°, it should be noted that there are much larger radiuses at the apexes compared with their counterpart designs in FIG. 4.

Figure 10:
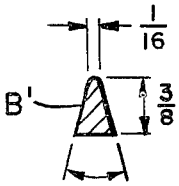
FIG. 10 is a sectional view of one of the embossments shown in FIG. 9.

FIG. 10 is a detailed cross section of design peak B' of FIGS. 8 and 9 having a depth dimension (⅜-inch) of a size found only in my home size pats. The structural specifications of this particular peak have a 1/16-inch diameter (1/32-inch radiused) apex and an inside acute angle of 30°. This is the kind of non-delicate structural design that will not break apart on demolding.

Figure 11:
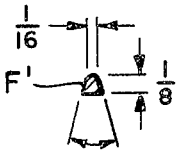
FIG. 11 is a sectional view of another embossment shown in FIG. 9.

FIG. 11 is a detailed cross section of design peak F' of FIGS. 8 and 9 having depth dimensions (⅜-inch) more usual in my restaurant size pats. The specification of this particular peak has a 1/16-inch diameter (1/32-inch radiused) apex and an inside angle of 30°. This, too, is the kind of non-delicate design that will not break apart on demolding.

In the enlarged FIGS. 5 and 6 and by comparison FIGS. 10 and 11, I have used only a 10° difference between the angles and a 1/32-inch difference between the radiused widths of the peaks to show causes for demolding breakage in embossed butter designs and by comparison the angles and peak widths that do not cause such breakage. But the dividing line between breakage and non-breakage occurs at about the 20° angle in combination with about 1/32-inch peak width.

These differences may appear to be small and insignificant, but they are large when one considers that a 30° angle encloses 50% more butter than a 20° angle of the same peak width, and that a 1/16 inch width peak encloses 100% more butter than a 1/32 inch width peak of the same angle.

It is differences such as these that spell the difference between failure and success when demolding embossed surfaced butter and margarine having identical body hardness characteristics similar to the softest butter now marketed in wrappers in the 1/4 lb. to 1 lb. cube weight sizes.

In general, FIGS. 12 through 15 show the package structures and functions used for molding, stacking, and demolding two commercially representative sizes and shapes of my embossed surfaced butter.

Figure 12:
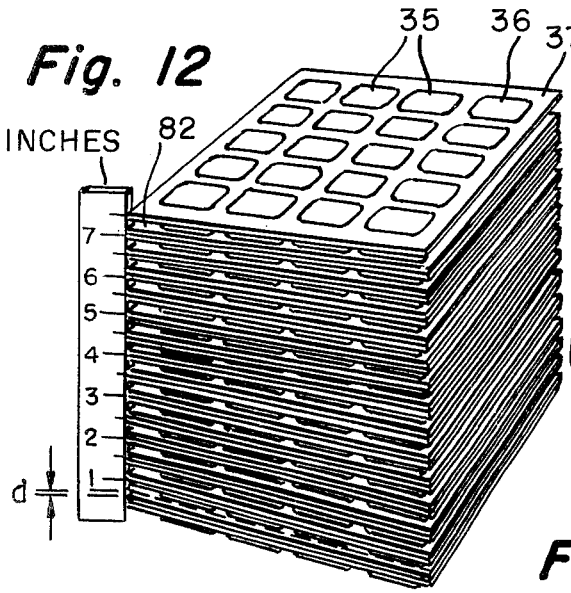
FIG. 12 is a perspective view of a 15-layer stack of small square restaurant size pats; 20 individual packages within each film-sheet package and layer.

FIG. 12 shows butter 35 that has been flow filled into embossing walled cavities 36 for restaurant size pats, the cavities are thermoformed in film-sheets 37, 0.0075 inches thick, having 20 cavities or packages per sheet. FIG. 12 shows a stack of 15 such film-sheets, and the vertical compression distance d of the cavities of the bottom film-sheet caused by the weight of the stack is 1/32 inch.

Figure 13:
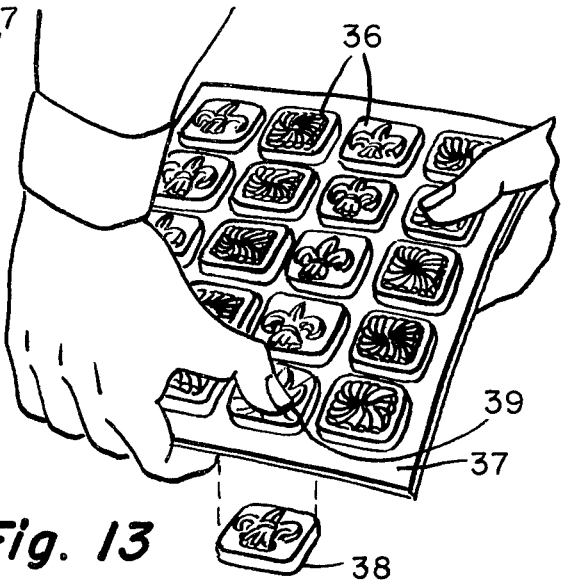
FIG. 13 is a perspective view showing a restaurant pat being demolded from its package.
Figure 13A:
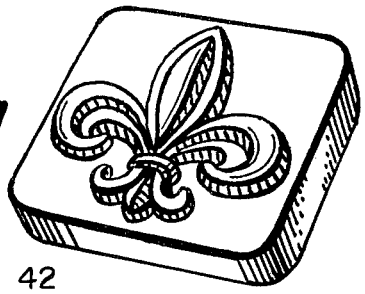
FIG. 13a is a perspective view of the demolded pat of FIG. 13, enlarged three times simply to illustrate the details of the design on this pat.

FIG. 13 shows the back side of one of the film-sheets 37 from which a pat 38 has been demolded by the push and pull functioning of this inventions's package walls, leaving the collapsed and expanded walls of the cavity 39.

Figure 14:
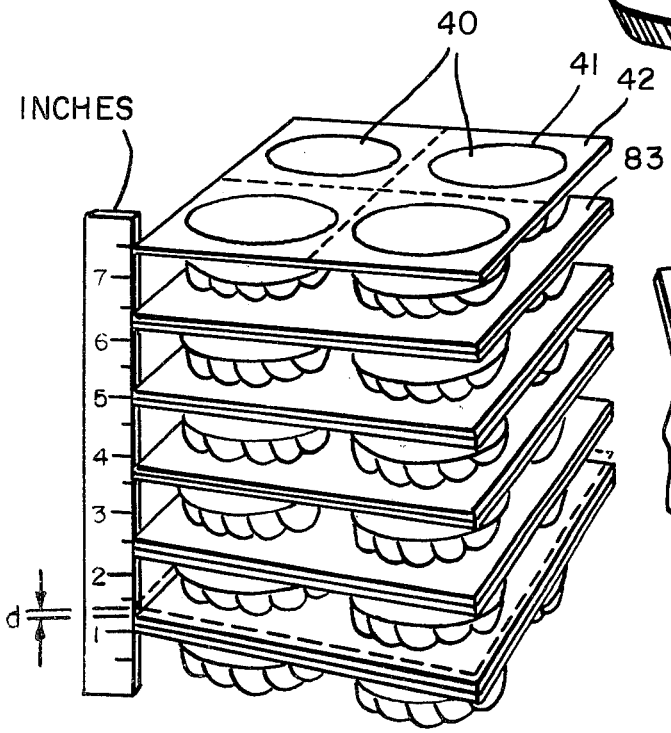
FIG. 14 is a perspective view of a 6 layer stack of large (1/4 lb.) round home size pats; 4 individual packages in each flim-sheet package and layer.

FIG. 14 shows butter 40 that has been flow-filled into embossing walled cavities 41 for home-size pats. The cavities are thermoformed in film-sheets 42, 0.0110 inches thick, having 4 cavities or packages per sheet. FIG. 14 shows a stack of 6 such film-sheets, and the vertical compression distance d of the cavities of the bottom film-sheet is 1/16 inch.

Figure 15:
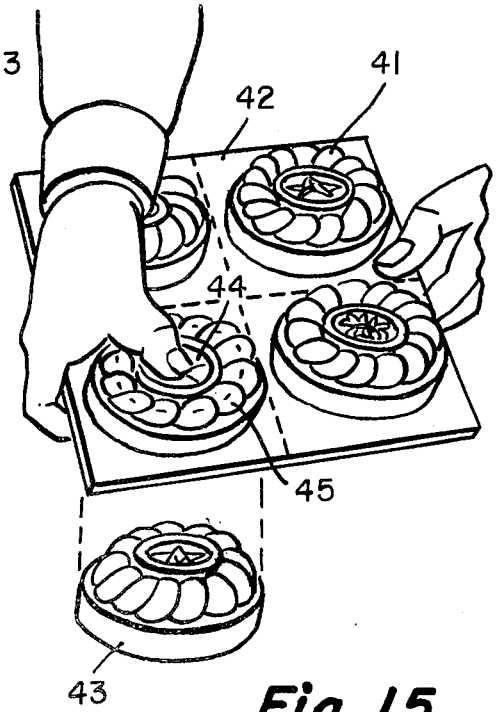
FIG. 15 is a perspective view showing a home-size pat being demolded from its package.

FIG. 15 shows the back side of one of the film-sheets 42 from which a pat 43 has been demolded by the push and pull functioning of this invention's package walls, leaving the collapsed and expanded condition of the package's walls clearly visible at 44 and 45, respectively, because of the large size of the package.

In FIGS. 16 through 19, I have used a large home size pat 43 with a multi-cubic-dimensioned embossed star design 47 at its top center to illustrate the collapsing-expanding, push-pull function that takes place with all sizes of designs and shapes of my embossed walled packages.

Figure 16:
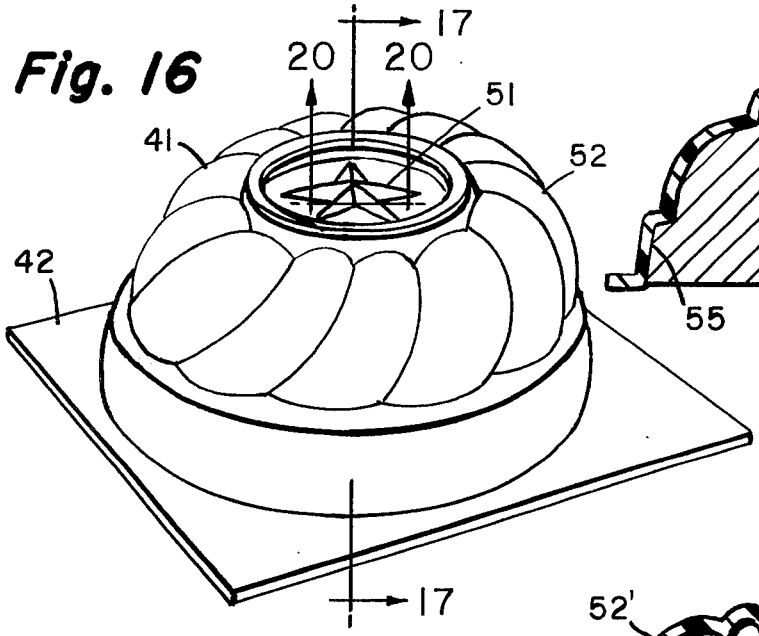
FIG. 16 is an enlarged perspective view of a single large pat in its package, open side down.

FIG. 16 is a back side view of one of the cavities 41 of the film-sheet 42 of FIG. 15 before its contents are demolded.

Figure 17:
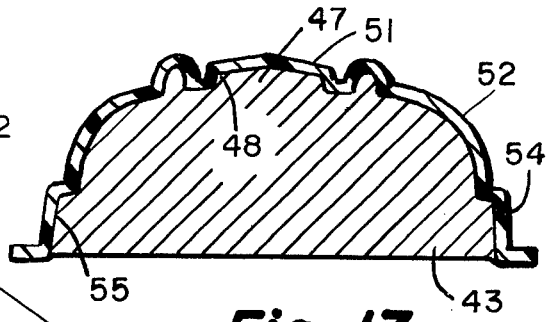
FIG. 17 is a sectional view of FIG. 16, taken along the line 17—17.

FIG. 17 is a cross section of the package and pat of FIG. 16 along the line 17—17 through the center of the star design showing the full and complete manner in which my flow-filled butter fills and wets itself into all the crevices 48 of my multi-cubic-dimensioned embossed cavity surfaces.

Figure 18:
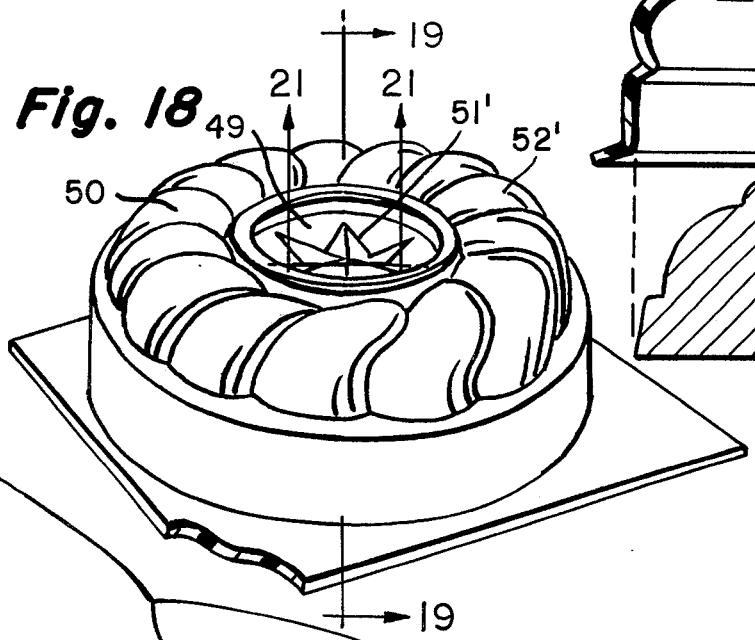
FIG. 18 is a perspective view of the package of FIG. 16 in a collapsed condition after its pat has been demolded.

FIG. 18 shows a portion 49 of the cavity collapsed and a portion 50 expanded during and after demolding of its contents. Note the collapsed condition of the star design 51' compared with its original erect condition 51 in FIG. 16, and the bulged out expanded walls 52' compared with their original erect condition 52 in FIG. 16.

Figure 19:
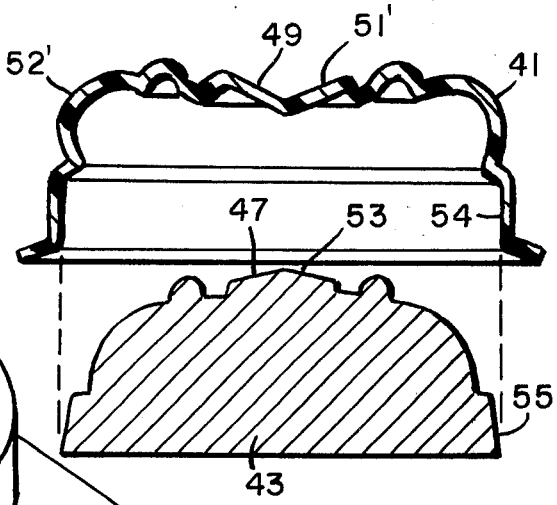
FIG. 19 is a sectional view of FIG. 18 taken along the line 19—19, showing the collapsed and expanded walls of the empty package of FIG. 18 and the condition of the demolded butter.

FIG. 19 illustrates more graphically the collapsed star 51' and the expanded walls 52'. It also shows the intact design perfections of the demolded embossed surfaces 53. Note especially the cross sectional base diameters of the embossing walls at 54 and the embossed butter at 55 before demolding in FIG. 17 and after demolding in FIG. 19. Despite the collapsed and expanded distortions of the embossing walls in FIG. 19, the base diameter of both the embossing cavity and the demolded butter have remained fixed during and after the demolding operation, as will be noted from a comparison of these base diameters in FIGS. 17 and 19.

Figure 20:
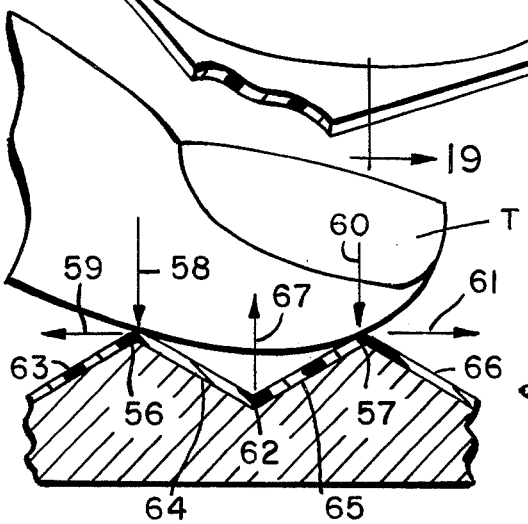
FIG. 20 is an enlarged sectional of FIG. 16 taken along the line 20—20 and showing a thumb about to demold the pat.
Figure 21:
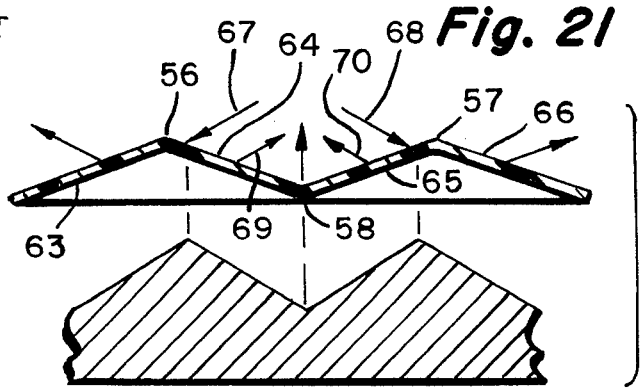
FIG. 21 is an enlarged sectional view of FIG. 18 taken along the line 21—21.

FIG. 20 is an enlarged cross section of two adjacent legs of the star design shown in FIG. 16. This figure along with FIG. 21 illustrates the actions and movements caused by a pushing thumb (see FIG. 15) that function during the conditions that are present when demolding butter from my package. The two peaks 56 and 57 of this section of the star, and the floor line in the valley 62 that lies between the peaks are all actual movement-directioned lines of orientation designed and thermoformed into this embossed area of this particular embossing walled cavity. It is along such lines that my embossing cavities will fold inwardly or outwardly, move toward or away from their enclosed butter contents with push-away and/or pull-away actions, depending on the particular direction their peak and valley lines are oriented. As peaks 56 and 57 are pushed out and down by thumb T in the direction of arrows 58,59,60, and 61, valley 62 moves out and up, each movement simultaneously producing multiple and sequential movements of the adjacent walls 63, 64, 65, and 66. The walls 64 and 65 which form the valley move down and out at and near the peaks in the direction of arrows 67 and 68 (FIG. 21) and up and out at and near the floor of the valley in the direction of arrows 69 and 70. During the actual time of demolding, all points move away from the butter except (a) the peaks 56 and 57 which continue to move toward the butter as at arrows 58 and 60 and (b) the areas near the peaks, which at first move down toward the butter and then up and away from the butter.

FIG. 21 may be used to compare the conditions of both the package and the buffer at demolding compared with their respective conditions in FIG. 20 before demolding. The peaks 56 and 57 of the star design in FIG. 21 have now moved and/or collapsed inward, and the floor 62 of the valley and its sides 64 and 65 have moved and/or expanded outward.

The original and selected area of the star design of FIG. 20 and the original embossing wall shapes of FIG. 16 and 17 are all now in their respective corresponding areas in FIGS. 21, 18, and 19, in either collapsed or expanded condition. They have been generally collapsed in their vertical dimensions and expanded in their horizontal or longitudinal dimensions. These general areas of collapse and expansion are to be expected because the direction of travel of the demolding butter is perpendicular and/or vertical from the bottom side to the open side of the cavity. However, particular areas of designs within any of the enclosed sides of the cavity can and do collapse and/or expand in directions contrary to the general direction of the side on which the design is located.

FIGS. 22 through 26 illustrate in a rectangular or bar shaped package the same type of embossing walled cavities, demolding movements, functions, and results shown in the square and round shaped packages of FIGS. 12 through 21.

Figure 22:
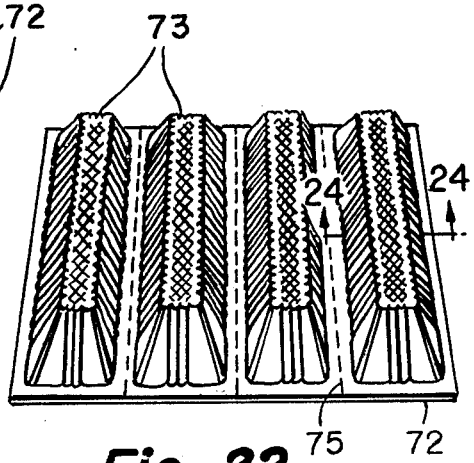
FIG. 22 is a perspective view of the back side of a package film-sheet having four rectangular-shaped large (1/4 lb.) home size individual packages.

FIG. 22 shows from the back side the shape and embossing designs of a rectangular package thermoformed from a film-sheet 72, 0.0150 inches thick, having 4 (1/4 lb. size) embossing walled cavities 73 formed therein.

Figure 23:
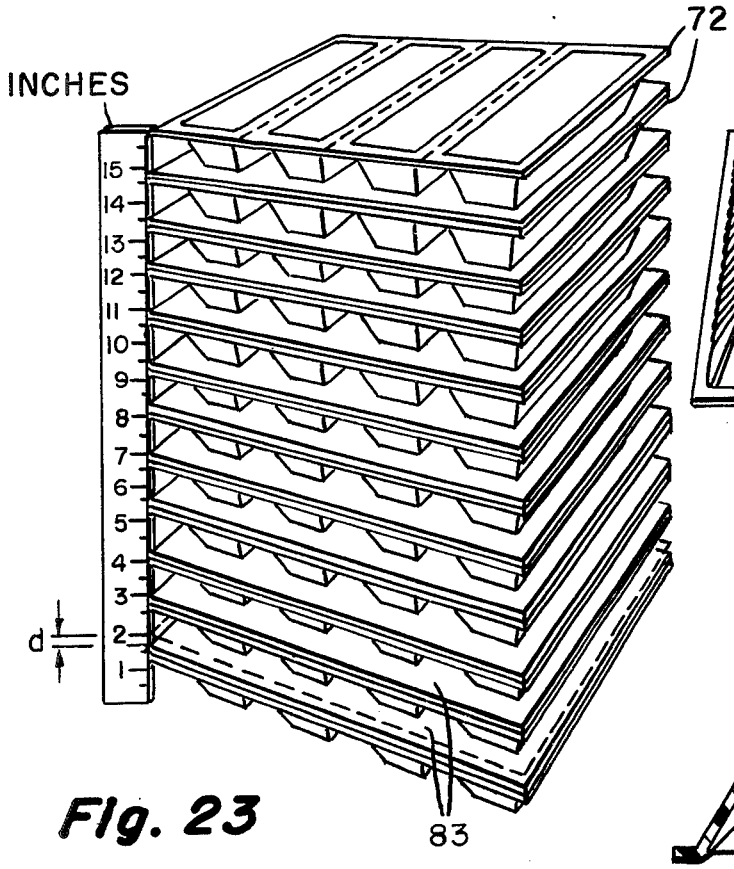
FIG. 23 is a perspective view of a stack of 12 of the packages of FIG. 22.

FIG. 23 shows that the thickness, shape, and surface designs of these particular butter embossing cavities will support 12 stacked layers of sheets with a compression *d* of 1/16 inch on the bottom cavity in the stacked column. The layers are twice in number and the stacked weight is more than double that shown in FIG. 14. Yet the compression is no greater than in FIG. 14. This illustrates the influence that film-sheet thickness, shape of package, and embossed design can have on the weight-bearing abilities of cavities within the demolding parameters of this invention's package.

Figure 24:
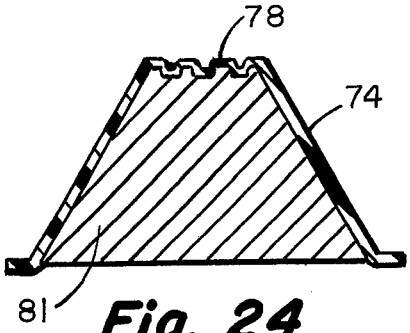
FIG. 24 is a fragmentary sectional view of the package of FIG. 22 taken along the line 24—24.

FIGS. 24 and 35 show a single package 74 after it has been torn apart along one of the perforation lines 75 of the film-sheet 72. The demolding method, movement, and results are similar to those shown in FIG. 15 for the round shape. Thumbs T (FIG. 25) push down and inward on the outer top surface of the cavity 75, while other fingers (not shown) hold the peripheral edges of the open side of the package cavity. The fold-oriented designs of the embossed package walls follow and fold either inward, as at 76 (FIG. 26), or outward, as at 77, the general direction of the pressures exerted by the demolding hands.

FIG. 24 shows a cross section of the rectangular package 74 before its contents have been demolded. In this shaped package it is at the midsection, where this cross section view is taken, that the pressures and movements of the package against the embossed butter surfaces are most critical. Any demolding actions that might multilate the embossed butter surfaces would occur in this area.

Figure 25:
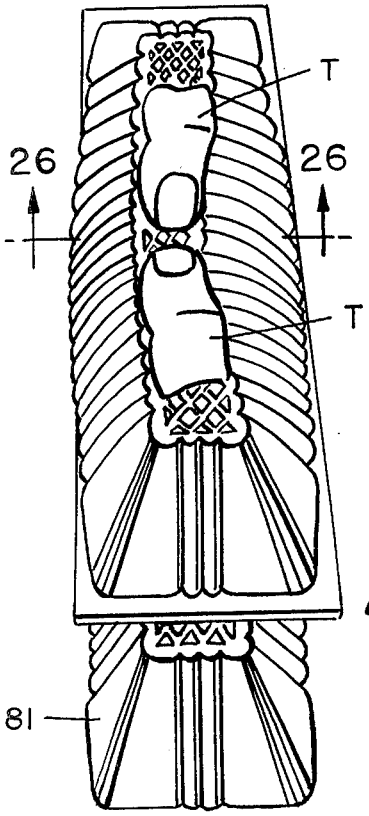
FIG. 25 is a perspective view of a 1/4 lb. portion of the package of FIG. 22 showing the butter being demolded.
Figure 26:
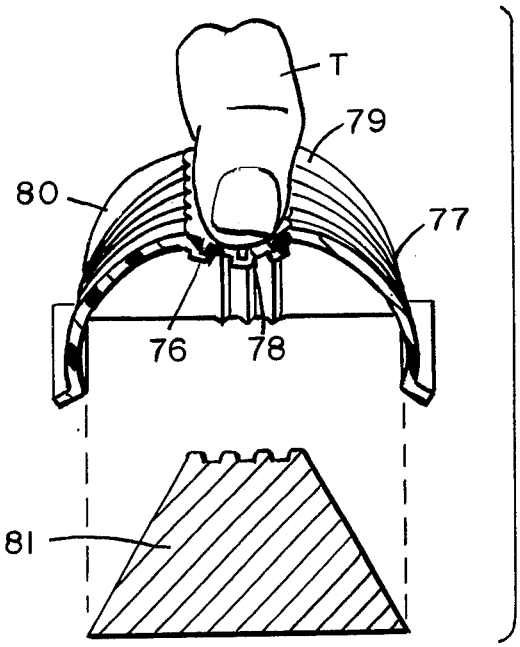
FIG. 26 is a fragmentary sectional view of FIG. 25 taken along the line 26—26, showing the collapsed and expanded walls of the empty package of FIG. 25 and the intact condition of the demolded butter.

Thumbs T in FIGS. 25 and 26 exert pushing pressure on the outside back of the cavity while other fingers (not shown) apply holding pressure on the open side's peripheral edges.

FIG. 26 shows the result of the thumb pressures exerted on the package and its contents. The top center area 78 of the package has been collapsed, pushed; while the size areas have been both collapsed in at 79 and expanded outward at 80. However, despite the extent and variety of the demolding package movements at home refrigerator temperatures, the embossed butter surfaces remain intact.

An Example for Small Restaurant Size Butter Pats

My embossed restaurant size pats range in weight from the smallest at 0.1185 ounces (135 pats per lb.) to the largest at 0.40 ounces (40 pats per lb.) with the most popular size at 0.20 ounces (80 pats per lb.). In this invention these pats are normally produced and sold in film-sheets 37, FIG. 12, containing 20 thermoformed embossed cavities per sheet and stacked 15 high in shipping containers. Normally, too, there is a thin, 0.006 to 0.010 inches thick, paperboard or plastic sheet 82 between each layer. The total stacked weight on top of the bottom pat for the 0.20 ounce size pat is about 4 ounces (1/4 lb.).

Tests with this stacked weight on this size pat show that the embossment-forming film-sheet cavities with the designs normally used for my 80 count pats will tolerate a vertical compression of about 1/32 inch without noticeably distorting the designs. Since my butter is normally fluid-filled into my embossed package cavities, I test the compression resistance of any film-sheet candidate immediately after filling, while the butter content is still fluid and offers very little resistance to, and thus very little protection against, weight produced pressures at the time when the package's resistance to such pressures is at its lowest point. After the butter has chilled and firmed up, it will add some resistance strength to the embossing package walls. But for resistance testing purposes, I prefer to use the firmed up butter contents as a margin of safety, and measure the resistance level of my package's walls when they offer their least resistance to the weight-produced pressures, i.e., at the time when the butter is still fluid in the cavity at the bottom of any stacked weights.

I have found that an embossed film-sheet of high impact polystyrene of 7 to 8 mil thickness will produce the required overall results for my embossed package walls that contain 0.20 ounces of butter. Such a thickness with this particular film-sheet and pat weight and butter will not produce a vertical compression of more than about 1/32 inch under the maximum commercially required stacked weight load. And its embossing walls will produce the desired push-pull, collapsing and expanding, demolding movement during demolding as shown in FIG. 13.

An Example for Large Home Size Pats

FIGS. 14 through 26 illustrate the packaging and demolding of my ¼ lb. home size pats. Their large size permits graphic illustration of the demolding movements and actions that also take place with my small butter pats.

My home use pats have a weight range from ⅛ pound to 1 pound, with the most popular size being ¼ pound. These pats are normally produced and sold in film-sheets containing four thermoformed embossed cavities per sheet, and containerized for shipping in either individual cartons or in stacks of 6 layers (FIG. 14) to 12 layers (FIG. 23). If containerized in layers, there are normally paperboard dividers 83 between each layer. The film-sheets, plus the butter content, plus the dividers produce a total stacked weight on top of each bottom pat of about 21 ounces for the stack of FIG. 14 and about 46 ounces for the stack of FIG. 23. Tests with these stacked weights for this size pat show that the embossment-forming film-sheet having cavities with the designs normally used for my ¼ lb. size pats will tolerate a compression of about 1/16 inch without distorting the designs.

I have found that an embossed film-sheet of high impact polystyrene of 10 to 15 mils thickness will produce the required overall results for all of my ⅛ to ¼ lb. home size pats, and 15 to 20 mils thickness for the ½ to 1 lb. sizes. Such cavity formed film-sheets will not compress more than about 1/16 inches under the maximum commercially required stacked weight load, and its embossing walls will produce the desired push-pull movement during demolding.

Both of the above-cited specific examples of my invention will solve all the problems and meet all of the objectives of this invention for the specific weights of embossed pats involved and the specific thicknesses of film-sheets involved. This is possible when one considers the significance of the preceding compression measurements.

The Significance of Compression Measurements

The compression measurements are taken under the maximum weight bearing and the minimum weight resistance capabilities of my cavities' self-supportiveness, i.e., at a time when a cavity has fluid butter in it. This is a time when a cavity's contents offer little or no resistance against pressure on the bottom of the lowermost cavity in a stacked column. Then, if the compression measurement does not exceed the limits necessary to maintain acceptable design integrity, as it does not do in the examples cited above, the film-sheet producing the specific acceptable compression may be used for the specific size pat used in the acceptable compression measurement.

In the examples cited above, it is obvious from the compression measurements that the designs are measurably altered by the compression-producing stacked weights. It is also obvious that the compression measurements would decrease as the stacked weight loads decrease, so that the base portion of the uppermost cavity in the stacked column has practically a zero compression, while the lowermost cavity in the stacked column has the largest compression measurement. Thus, it is obvious that there are some differences and/or distortions in the embossing and embossed designs between the uppermost and lowermost packages in a stacked column. However, these differences, as illustrated by the above compression examples:

a. are not sufficiently great to be noticeable when the butter from the stacked cavities is demolded;

b. do not involve any embossment destruction or multilation, because the stacking takes place when the butter in the cavity is fluid and it will conform to whatever cavity alteration occurs. Then upon solidification by refrigeration which will take place during its stacked tenure, the butter will simply be in conformity with the slightly compression-altered shape produced by the stacked weights. Also then, because of the adhesive contact with its solidified butter contents, the slightly altered cavity will not return to its pre-filled, pre-stacked slightly differenced original shape as long as such adhesive contact is maintained, which it is throughout the normal channels of distribution. Thus, the embossed butter will be demolded by the consumer without any noticeable alterations of its embossed designs.

It is to be understood that in the event it is commercially desirable to use my thinner cavity film-sheets for molding and demolding my heavier butter pats, I can eliminate stacked weights on such pats by enclosing them in cartons which then would bear the pressures of any stacked columns. This in no way departs from the spirit and novel demolding functioning of my invention.

The Significance of the Bottom Side of the Embossing Cavities

Since the bottom of the cavity is the side that bears the brunt of both the filling and demolding pressures, both the cavity and surface design structures in this area must always consider the dual functions it must perform, namely, (1 ) a level and firm based self-supportiveness during filling and (2) an easy design-and-shape collapsibility-expandability during demolding. Since the most important function of this invention is demolding, the cavity and design structures on the bottom side must give first consideration to the demolding functions of collapsibility and expandability. To provide these all-important functions, it is helpful to consider the options that can provide them, while at the same time provide the filling function of self-supportiveness.

FIGS. 13, 15, and 22 illustrate three different bottom side structues. Two of them, FIGS. 15 and 22, show bottom sides of two different cavity shapes having areas sufficiently centered, level planed, and broad to provide a firm base on which single cavities can rest in self-supporting posture while being filled, and do so without destroying whatever collapsible-expandable embossing designs have been thermoformed into the bottom walls.

FIG. 13, however, shows embossing designs that do not combine a sufficiently centered and/or broad area on which single designs can rest in self-supporting positions during filling. Rather than alter such designs to enable them to be filled singly, a better (less costly) option is to fill them in attached groupings of at least four or more which gives them at least four base locations on which to cooperatively maintain themselves on and in a self-supporting, level-plane filling posture. Because the pats in FIG. 13 are small, I use 20 cavities to provide such self-support and level-plane posture for each of the twenty.

Thus, by providing the option of self-supporting package structures with both single cavity filling and attached multiple group cavity filling, this invention increases the choices for embossing designs and film-sheet thicknesses within the range of thicknesses and parameters for the collapsing-expanding functions defined by this invention.

In the foregoing specification I have given a detailed description of the problems, objectives, solutions, and specific embodiments of my invention for the purpose of both illustration and careful instruction. I have disclosed a novel, surprising, and commercially important contribution to the art of packaging embossed butter and margarine. The specific, combined, and cooperative teachings are major advancements in the specific area of demolding such products and, if followed, will yield significant benefits, especially in terms of greater convenience and lower costs, for the consumers of these products.

It is to be understood that many of the details herein given may be varied considerably by those skilled in the art without departing from the spirit and scope of the invention.

I claim:

1. A package for demolding embossed butter or firm bodied margarine when the butter or margarine is within the temperature range of 38° to 48°F. comprising in combination a thermoformable plastic film-sheet within the thickness range of 0.005 to 0.20 inch having a single-walled, unlined cup-like cavity thermoformed therein and flow-filled butter or margarine filling the cavity, the butter or margarine being firmed to a solid cube by refrigeration; the film-sheet being shaped to provide the cavity with an opening through which said cavity is filled and emptied, a bottom wall oppposite the opening having an embossed but nevertheless level plane area sufficient to support said cavity in an opening-upright, self-supporting posture during filling and shipping; a side wall extending from the bottom wall to the opening and having an inward taper from the edge and plane of the opening of an angle of no less than 5° in non-embossed portions of the side wall, and an angle of not less than 10° in embossed portions of the side wall; the cavity having a multi-cubic-dimensioned embossed surface for molding the surfaces of said cube; the embossed surface having pointed peaks with the tops thereof having radiuses of no less than 1/32-inch and angles of no less than 20° whereby finger pressure applied on the outside of the cavity causes collapsing and/or expanding movements of portions of the embossed surface of sufficient extent to push and/or pull said portions away from said cube and demold the embossed surfaces of the cube intact when the cube is within the temperature range of 38° to 48°F.

2. A cup-like package for demolding with their surface designs intact, multi-cubic-dimensioned embossments on the surfaces of a cube of butter or firm-bodied margarine in the weight range of 0.1185 oz. to 16 oz. at a temperature withn the range of 38° to 48°F., the package comprising a plastic film-sheet within the thickness range of 0.005 to 0.020 inches thermoformed to provide a female die-casting single-walled, unlined cavity having an open top and closed sides and having fold-oriented embossing designs on the inside surfaces of its closed sides, whose design-delicacy on the inside is of an order that limits the sharpest peaks of the embossing designs to a radius at their points of no less than 1/32 inch and to acute angles of no less than 20°, said cavity being filled with flow-filled butter or margarine which is firmed to a cube by refrigeration, said cube being formed and surface embossed as the male member of said die-casting cavity when held within the temperature range of 38° to 48°F., whereby pressing on the outside of the package causes collapsing and/or expanding movements within said fold-oriented embossing walls which cause said walls to push and pull away from said embossed surface of the cube and to demold said cube from said package with its die-cast embossed surfaces intact.

3. A package for butter or firm-bodied margarine comprising a monolithic plastic film-sheet in the thickness range of 0.005 to 0.020 inch which is thermoformed into a single-walled, unlined cup-like cavity having an open mouth and closed sides, the cavity being filled with butter or margarine flow filled through the open mouth thereof, the filled cavity being self-suppportive, the closed sides of the cavity having multi-cubic-dimensioned embossments whose sharpest points have radiused peaks of no less than 1/32 inch and inside acute angles of no less than 20°, the butter or margarine being provided with an embossed surface by the embossments of the cavity whereby finger pressure on the outside of the package when refrigerated within a temperature range of 38° to 48°F. will cause collapsing and/or expanding movements of the closed sides of the cavity of sufficient extent to push and/or pull themselves away from the embossed surfaces of the butter or margarine and demold the butter or margarine from the cavity with its embossed surfaces intact, unbroken, and complete.

4. A package for demolding intact, surface designs on cubes of butter or firm-bodied margarine at a temperature within the range of 38° to 48° F. comprising butter or margarine having a hardness body no softer than the softest commercially-produced butter, flow filled into and filling a plastic film-sheet having a thickness within the range of 0.005 to 0.020 inch thermoformed into a cup-like single-walled, unlined, open-mouth cavity which is self-supporting under the weight of its filled contents, said cavity having closed walls provided with multi-cubic-dimensioned embossing fold-oriented designs thereon, said designs having their sharpest peaks limited in sharpness to radiused points no smaller than a 1/32 inch radius and their included acute angles no smaller than 20°, said fold-oriented designs enabling collapsing and/or expanding movements to function for pushing and/or pulling said cavity walls away from said butter or margarine under finger pressure exerted on the outside of said walls at demolding temperatures within the range of 38° to 48° F.

5. A cup-like package for demolding a cube of butter or firm-bodied margarine at a temperature range of 38° to 48° F. comprising a thermoformable plastic film-sheet within the thickness range of 0.005 to 0.020 inch providing a monolithic walled material in which a single-walled, unlined embossing cavity is thermoformed; the embossing cavity having an open side through which it is filled and emptied, closed sides having multi-cubic-dimensioned embossing surfaces on the inside of the cavity including a bottom which, along with the closed sides, provides a self-supporting level-plane structure and posture during filling, shipping, and storage and maintains the open side in an upright position; design structurings for said embossing surfaces being fold-oriented but limited to pointed peaks with radiuses of no less than 1/32 inch in combination with inside acute angles of no less than 20°, and butter or margarine flow-filled into said cavity whereupon under refrigeration said butter or margarine is solidified into an embossed surfaced cube conforming to the shape and embossing surfaces of said cavity, the closed sides being shaped so that finger pressure on the outside of the cavity will provide collapsing and/or expanding movements of the embossing surfaces of the cavity, and, in turn, actions that function to push and/or pull said embossing surfaces away from said embossed surfaced butter or margarine and demold said embossed surfaces intact and undamaged while under the home refrigerator temperatures of 38° to 48° F.

6. A method for demolding at a temperature within the range of 38° to 48° F. multi-cubic-dimensioned designs molded on the top surfaces of cubes of butter or firm-bodied margarine comprising forming from a thermoplastic film-sheet having a thickness within the range of 0.005 to 0.020 inch a cup-like, single-walled, unlined cavity having multi-cubic-dimensioned embossing fold-oriented designs thermoformed on its inside surfaces, limiting said embossing surfaces to designs that will mold butter and margarine surfaces whose sharpest points and peaks are no sharper than 1/32 inch radius and whose inside acute angles are no less than 20°, flow-filling butter or margarine into said cavity whereby it is filled and cast into, and molded by, said embossing surfaces, refrigerating said flow-filled and cavity-cast embossed-surfaced butter or margarine to change it from a fluid phase to a solid phase for demolding at temperatures within the 38° to 48° F. range, thereafter demolding said refrigerated butter or margarine by turning said cup-like cavity open-side down, and pressing on the top outside of said cavity, thereby producing on said embossing surfaces collapsing and/or expanding movements which function with an action that pushes and pulls said embossing surfaces away from said embossed surfaces, thereby releasing said embossed surfaces from said embossing surfaces with said designs unbroken and intact.

* * * * *

UNITED STATES PATENT AND TRADEMARK OFFICE

CERTIFICATE OF CORRECTION

PATENT NO. : 3,976,796

DATED : August 24, 1976

INVENTOR(S) : Leo Peters

It is certified that error appears in the above-identified patent and that said Letters Patent are hereby corrected as shown below:

In column 33, line 35, "withn" should be --within--.

In column 33, line 53, "surface" should be --surfaces--.

In column 34, line 1, "the" second occurrence should be -- said --.

Signed and Sealed this

First Day of February 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,976,796

DATED : August 24, 1976

INVENTOR(S) : Leo Peters

It is certified that error appears in the above–identified patent and that said Letters Patent are hereby corrected as shown below:

In column 2, line 47, "determnes" should be --determines--;

In column 4, line 11, "art/s" should be --art's--;

In column 5, line 4, "work" should be --word--;

In column 20, line 40, "pressures as" should be --pressures so as--;

In column 22, line 27, "rise" should be --rises--;

In column 22, line 39, "frictional" should be --fractional--;

In column 22, line 42, "tighyly" should be --tightly--;

In column 22, line 44, "spaces" should be --spaced--;

In column 23, line 1, "of criteria" should be --or criteria are--;

In column 23, line 6, "now" should be --how--;

In column 26, line 5, "radisued" should be --radiused--;

In column 26, line 7, "B, C, C, and E" should be --B, C, D, and E--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*